US010988923B2

(12) United States Patent
Dyson et al.

(10) Patent No.: US 10,988,923 B2
(45) Date of Patent: Apr. 27, 2021

(54) METHODS AND SYSTEMS OF MODIFYING AIR FLOW AT BUILDING STRUCTURES

(71) Applicant: Rensselaer Polytechnic Institute, Troy, NY (US)

(72) Inventors: Anna Dyson, New York, NY (US); Jason Vollen, Brooklyn, NY (US); Michael Amitay, Loudonville, NY (US); Peter Stark, Brooklyn, NY (US); Ajith Rao, Montpelier, VT (US); Edward DeMauro, Schenectady, NY (US); David Menicovich, Hoboken, NJ (US)

(73) Assignee: Rensselaer Polytechnic Institute, Troy, NY (US)

( * ) Notice: Subject to any disclaimer, the term of this patent is extended or adjusted under 35 U.S.C. 154(b) by 1042 days.

(21) Appl. No.: 14/647,986

(22) PCT Filed: Mar. 15, 2013

(86) PCT No.: PCT/US2013/032287

§ 371 (c)(1),
(2) Date: May 28, 2015

(87) PCT Pub. No.: WO2014/084891

PCT Pub. Date: Jun. 5, 2014

(65) Prior Publication Data

US 2015/0308103 A1 Oct. 29, 2015

Related U.S. Application Data

(60) Provisional application No. 61/731,889, filed on Nov. 30, 2012.

(51) Int. Cl.
*E04B 1/74* (2006.01)
*F24F 7/00* (2021.01)
(Continued)

(52) U.S. Cl.
CPC ..... *E04B 1/74* (2013.01); *E04F 19/00* (2013.01); *F24F 7/00* (2013.01); *F24F 11/0001* (2013.01);
(Continued)

(58) Field of Classification Search
CPC ..... E04B 1/74; E04F 19/00; F24F 7/00; F24F 11/0001; F24F 13/26; F24F 7/007; F24F 2221/50; F24F 2007/004
(Continued)

(56) References Cited

U.S. PATENT DOCUMENTS 3,529,862 A * 9/1970 Jousserandot ..... B62D 35/00 296/180.1
6,471,477 B2 * 10/2002 Hassan ..... B64C 23/04 244/130
(Continued)

FOREIGN PATENT DOCUMENTS

EP 2108902 A2 * 10/2009 ..... F25B 9/04
FR 2271430 A1 12/1975
(Continued)

OTHER PUBLICATIONS

Menicovich et al., "A Different Approach to the Aerodynamic Performance of Tall Buildings," Council on Tall Buildings and Urban Habitats Journal, 2012, IV:18-23.

*Primary Examiner* — Steven B McAllister
*Assistant Examiner* — Dana K Tighe
(74) *Attorney, Agent, or Firm* — Murtha Cullina LLP

(57) ABSTRACT

Provided in one embodiment is a method of modifying an air flow at least one location of a building structure, comprising: generating a first air flow at the at least one location of the building structure; and modifying a second air flow exterior
(Continued)

to the building structure using the generated first air flow. An apparatus configured to modified an air flow is also provided.

36 Claims, 34 Drawing Sheets

(51) Int. Cl.

| | |
|---|---|
| ***F24F 11/00*** | (2018.01) |
| ***F24F 13/26*** | (2006.01) |
| ***E04F 19/00*** | (2006.01) |
| *F24F 7/007* | (2006.01) |

(52) U.S. Cl.
CPC ..... *F24F 13/26* (2013.01); *F24F 7/007* (2013.01); *F24F 2007/004* (2013.01); *F24F 2221/50* (2013.01)

(58) Field of Classification Search
USPC ..... 454/11, 15, 188, 250, 370
See application file for complete search history.

(56) References Cited

U.S. PATENT DOCUMENTS

| | | | | |
|---|---|---|---|---|
| 8,134,252 | B2 | 3/2012 | Pagliasotti | |
| 8,257,020 | B2 | 9/2012 | Graham, Sr. | |
| 8,887,482 | B1 * | 11/2014 | Ruggeri | F02K 1/82 431/1 |
| 2004/0037162 | A1 | 2/2004 | Flohr et al. | |
| 2005/0103944 | A1 * | 5/2005 | Greenblatt | B64C 23/04 244/200.1 |
| 2009/0223305 | A1 * | 9/2009 | Zapalski | F15D 1/00 73/861.24 |
| 2010/0104436 | A1 * | 4/2010 | Herr | F03D 1/06 416/31 |
| 2010/0140416 | A1 * | 6/2010 | Ohanian, III | B64C 21/04 244/23 A |
| 2010/0284825 | A1 * | 11/2010 | Land, III | F04F 5/00 417/48 |
| 2011/0315248 | A1 | 12/2011 | Simpson et al. | |
| 2012/0012286 | A1 * | 1/2012 | Salamon | F28F 3/04 165/120 |
| 2012/0134753 | A1 | 5/2012 | Simpson et al. | |
| 2014/0064036 | A1 * | 3/2014 | Tseng | G10K 7/00 367/190 |

FOREIGN PATENT DOCUMENTS

| | | | |
|---|---|---|---|
| JP | 02-266071 | A | 10/1990 |
| JP | 10-281115 | A | 10/1998 |
| JP | 11-082283 | A | 3/1999 |
| JP | 2002-194826 | A | 7/2002 |
| JP | 2004-019966 | A | 1/2004 |
| JP | 2004-285756 | A | 10/2004 |
| WO | WO 00/55036 | A2 | 9/2000 |
| WO | WO 2008/116824 | A2 | 10/2008 |
| WO | WO 2012/073060 | A1 | 6/2012 |
| WO | WO 2012/073060 | A9 | 6/2012 |

* cited by examiner (a)

(b)

1. BASED ON GLEZER, ARI, AND MICHAEL ANAJARY. SYNTHETIC JETS. ANNUAL REVIEW OF FLUID MECHANICS. 2002;34:503-529.

METHODS AND SYSTEMS OF MODIFYING AIR FLOW AT BUILDING STRUCTURES

RELATED PATENT APPLICATION

This application claims priority to U.S. Provisional Application Ser. No. 61/731,889, filed Nov. 30, 2012, which is incorporated herein by reference in its entirety.

BACKGROUND

Contemporary methods for tall building construction typify the prevailing modern paradigm in which building envelopes are intended to maximally isolate interior spaces from the climatic environment by minimizing energy transmission at the building envelope. As a result, they tend to rely comprehensively on energy-intensive mechanical systems to deliver adequate air supply. Furthermore, tall buildings currently contribute to non-renewable material consumption within the building sector in order to meet desired aerodynamic performance bench mark for wind-related applications. (e.g., cross-wind response reduction or integrated wind energy generation) through solid-based aerodynamic modification ("SAM"), either by changing structural or geometric characteristics such as the building's shape or through the use of materials and the addition of auxiliary damping.

While our environment contains mostly fluids, conventional building methods are primarily restricted to approaching investigations of the interactions between buildings and their surroundings by using solid modeling. As a result, the design of tall buildings has relied on both a solid-based aerodynamic modification (SAM) approach to meet a desired aerodynamic performance bench mark and on techniques to modify the geometry of the building (Geometry-based Aerodynamic Modification or "GAM") or its structural properties, such as stiffness through the use of materials and auxiliary damping systems. Although these techniques do provide a narrow path for success, they do not adapt to fluctuating environmental conditions and are accompanied by a loss of useful floor area and an increase in total energy cost.

SUMMARY

In view of the foregoing, the Inventors have recognized and appreciated the advantages of a system and a method of actively controlling air flow to manipulate the building boundary layer to achieve a desired performance level.

Accordingly, provided in one embodiment is a method of modifying an air flow at at least one location of a building structure, comprising: generating a first air flow at the at least one location of the building structure; and modifying a second air flow exterior to the building structure using the generated first air flow.

Provided in another embodiment is an apparatus configured to modify an air flow at at least one location of a building structure, the apparatus comprising: an apparatus housing; and a flow generator in the housing, the flow generator configured to generate a first air flow at the at least one location. The generated first air flow may modify a second air flow exterior to the building structure.

Provided in another embodiment is a building structure, comprising an apparatus at at least one location of the building structure, the apparatus comprising: an apparatus housing; and a flow generator in the housing, the flow generator configured to generate a first air flow at the at least one location. The generated first air flow may modify a second air flow exterior to the building structure at the at least one location of the building structure.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

DETAILED DESCRIPTION

Following below are more detailed descriptions of various concepts related to, and embodiments of an inventive system and a method of actively controlling an air flow to manipulate the building boundary layer to achieve a desired performance level. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Method of Modifying Air Flow

Provided in one embodiment is a method of modifying an air flow at at least one location of a building structure, comprising: generating a first air flow at the at least one location of the building structure; and modifying a second air flow exterior to the building structure using the generated first air flow.

The building structure may comprise any type of building structure. For example, the building may be a high rise building, a low rise building, or any static body. In some instances, while the building structure is stationary, the structure may be on a mobile platform. In one embodiment, the building structure may comprise at least one bluff body.

Figure 31:
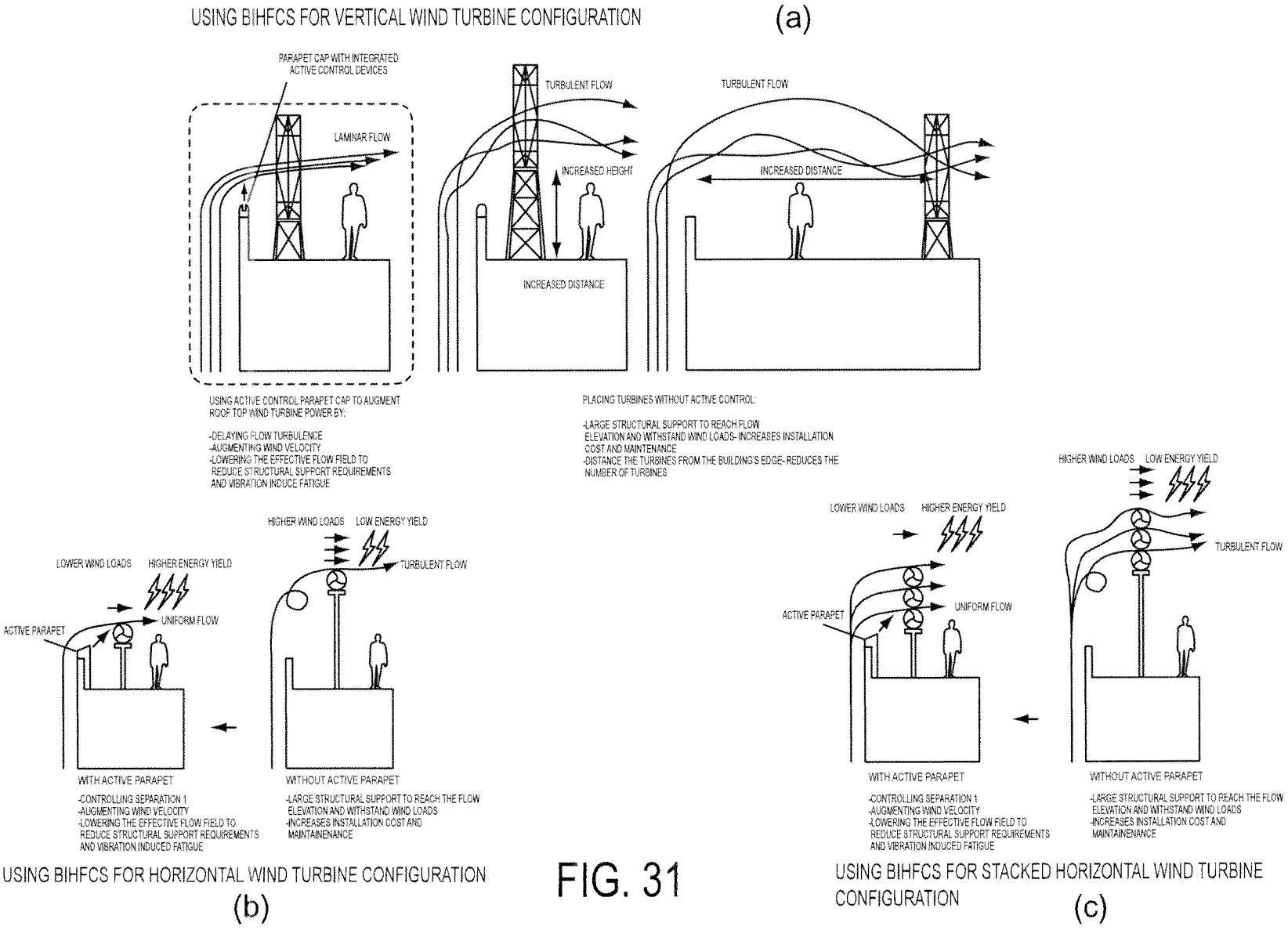
FIGS. 31(*a*)-31(*c*) provide schematics showing manipulating wind flow with an active control system at rooftop conditions in one embodiment; (a) shows using building integrated active and hybrid flow control systems ("BIHFCS") for vertical wind turbine configuration; (b) shows using BIHFCS for horizontal wind turbine configuration; and (c) shows using BIHFCS for stacked horizontal wind turbine configuration.
Figure 32:
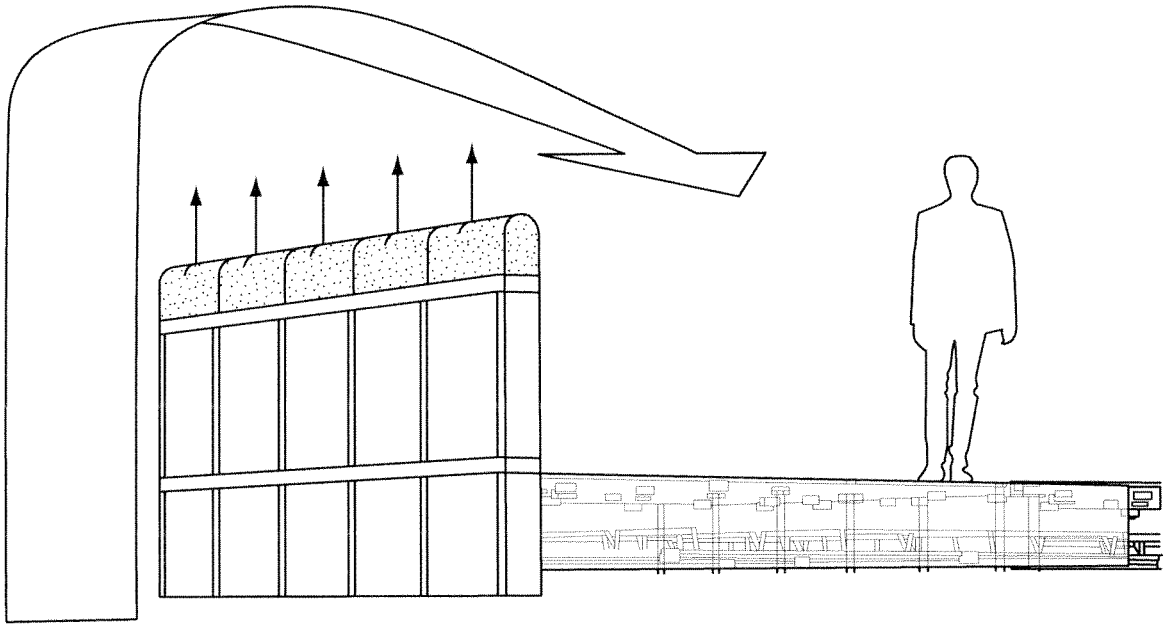
FIG. 32 provides a schematic showing manipulating wind flow with an active control system at rooftop conditions in another embodiment.
Figure 33:
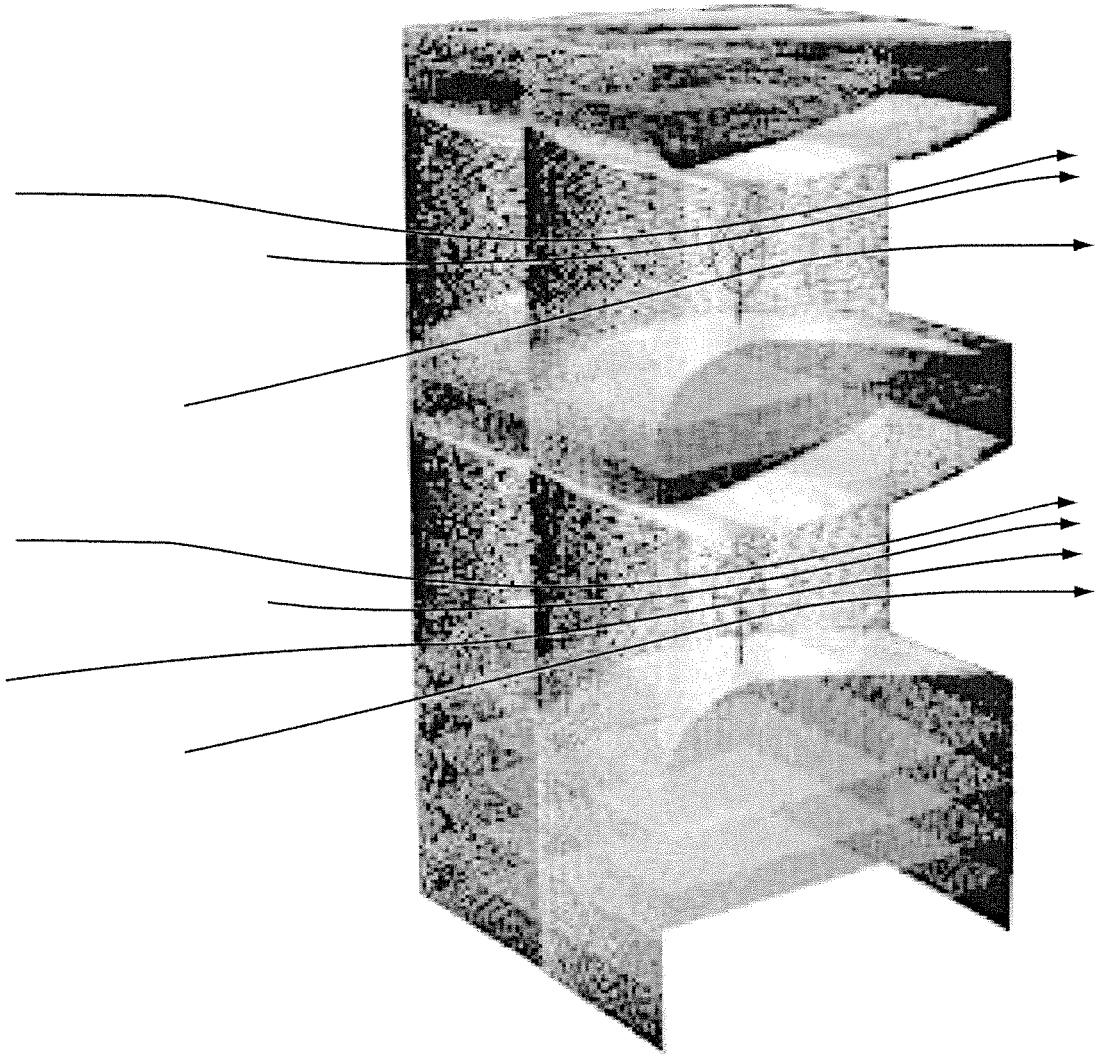
FIG. 33 provides a schematic showing section of wind amplified rotor platform ("WARP") based building with integrated wind turbine in another embodiment.

In one embodiment, the at least one location where the air flow is modified may be at one or more locations of the building structure. The phrase "at a location" (e.g., of a building structure) in at least one embodiment may refer to within, at, and/or outside of the building structure. In one embodiment, the location may be at an edge of the building structure. For example, the location may be at a side (or multiple sides), the top, or both, of the building structure. In one embodiment wherein the building structure has a geometry without sharp edges, the location may be at a location on the circumference of the building structure. In one alternative embodiment, the location may be integrated within the building envelope of the building structure. The location could be at any point of the envelope: its edges and/or its surfaces. In one embodiment, the apparatus may be integrated into envelope surfaces (e.g., cladding panels, glazing units, the framing of cladding elements, curtain wall mullions, and spandrel, etc.) or as a standalone component. The apparatus may also be integrated into an extension of the envelope edge, as shown in FIGS. 31(*a*)-31(*c*) and 32, where the apparatus is integrated into the building parapet.

The first air flow may comprise a pulsed air flow, a constant air flow, or both. In one embodiment, before the modification of the second air flow takes place, the generated first air flow may be combined with a third air flow that comprises a pulsed air flow. The term "pulsed" herein is not restricted to any particular frequency. Depending on the application, the pulsation of the air jet may be of any value. The terms "first, second," "third," etc. are employed herein only to denote the different entities these terms are employed to describe and are not meant to convey that the entities need to be in a particular sequence. Thus, in some instances the order may be changed.

The first air flow may be generated by any suitable techniques and machinery. For example, the first air flow may be generated by at least one mechanical air flow system. In one instance, the air flow is generated by a compressed air system. In one embodiment, the mechanical system is configured to generate various types of air jets for the air flow. Depending on the application, the mechanical system may or may not generate an air jet that is a part of the first air flow, or is the air flow. The air jet may include a pulsating air jet, a constant air jet, or both. In one embodiment, the generation of the first air flow involves at least one pulsating air jet. In another embodiment, the generation of the first air flow does not involve any pulsating air jet. In one embodiment, the first air flow is generated in the building interior shafts and blowing ports by at least one of (i) indoor buoyancy and (ii) atmospheric pressure differences around the building, and (iii) exhaust air. The exhaust air may be from a system such as heating, ventilation, and/or heating mechanical system. In one embodiment, the first air flow may be generated using resources that are already existing air flows to channel them to the outside of the building. Therefore, in this embodiment, The reliance on existing resources minimize (or remove substantially, or even remove completely) a need for energy investment. In one embodiment, such a design is different from generating the jets by electricity or compressed air.

The generation of the first air flow may involve using an energy source to generate the flow. The energy source may be any type of device that facilitates providing power/energy to the suitable instrument and/or machinery to generate the first air flow. The energy source may be located inside or outside of the building structure. Alternatively, the energy source may be attached to the building structure. The energy source may be configured to operate independently of an existing power system of the building structure. Alternatively, the energy source may be an integral part of an existing power system of the building structure. In one embodiment, the energy source is configured to divert energy from an existing power system of the building structure.

The second air flow may be exterior to the building structure. The second air flow may comprise a natural flow of ambient air moving relative to the building. The flow may be of any manner with respect to velocity, direction, etc. For example, the flow may be inward into the interior of the building structure, outward into the exterior of the building structure, along a side of the building structure, around a corner of a building structure, etc.

The modification of an air flow in one embodiment may refer to imposing a change to the air flow. The change may refer to any type of change. For example, the change may be with respect to the velocity, direction, manner (e.g., turbulence, laminar, etc.), and the like. In one embodiment, the modification may refer to controlling an air flow so that the flow reaches a predetermined or pre-designated level or value. For example, the modification of an air flow may include controlling and tailoring the flow to have a specific flow velocity, direction, manner, etc. In contrast to the preexisting GAM model, the modification provided in at least one embodiment herein may involve substantially no change to the geometry of the building structure.

The modification of the second air flow may comprise applying the generated first air flow to the second air flow to control the second air flow (with respect to velocity, direction, manner, etc.). The application of the generated first air flow to the second air flow may create a third air flow that is different from the second air flow. As a result, the second air flow is modified to become a combination of a second and a third air flows. In one alternative embodiment, the second flow would substantially (or completely) cease to exist as a result of the modification of the second air flow by the generated first air flow. In such a case, the modified air flow may be a third air flow that is different from the second air flow. In one embodiment, the method of modifying an air flow comprises using a pressure differential to transfer into an interior of the building structure the second air flow and releasing the transferred-in second air flow back to the exterior of the building structure.

Figure 29:
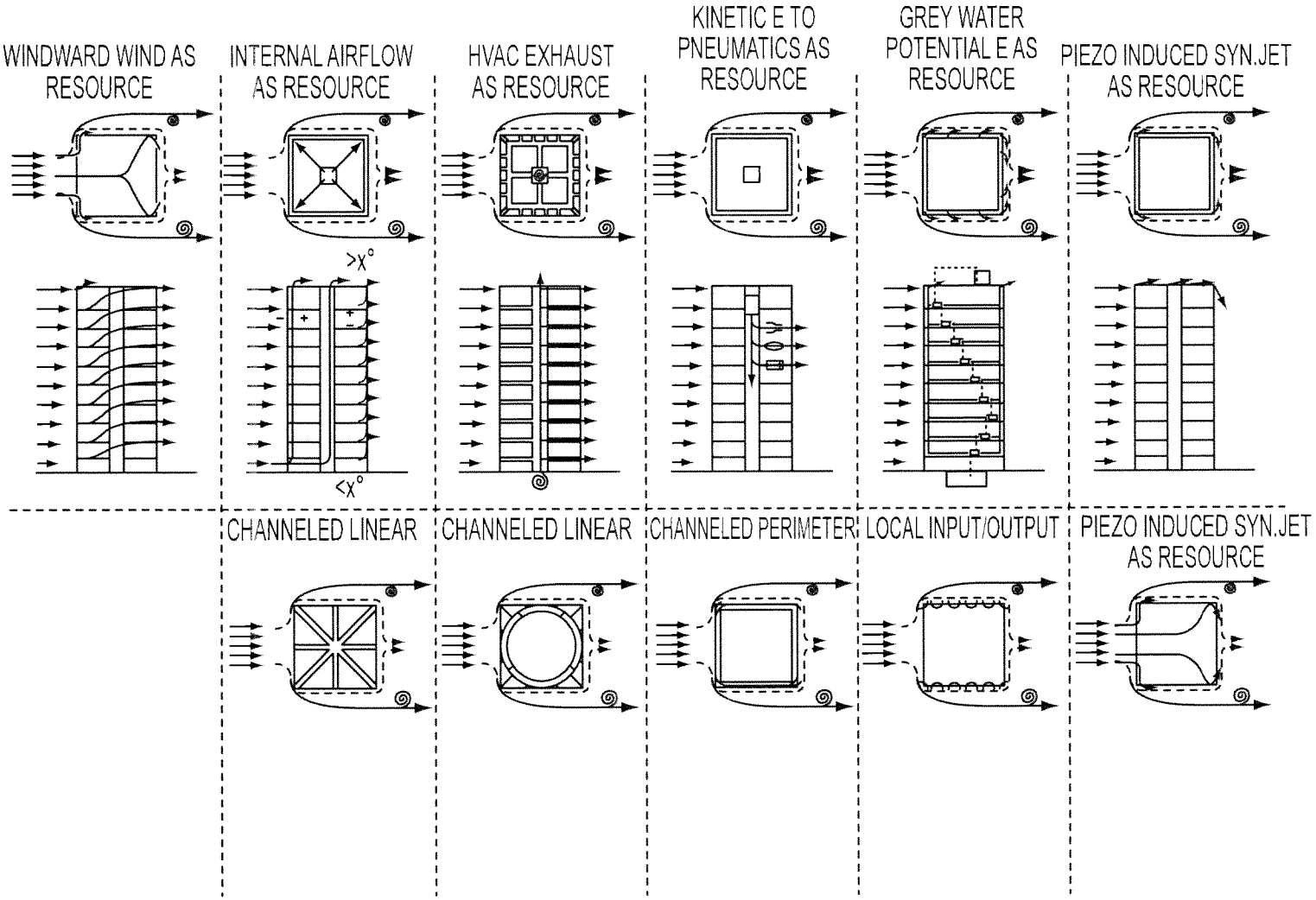
FIG. 29 provides a diagram showing resources and techniques to control flow patterns around buildings in one embodiment.
Figure 30:
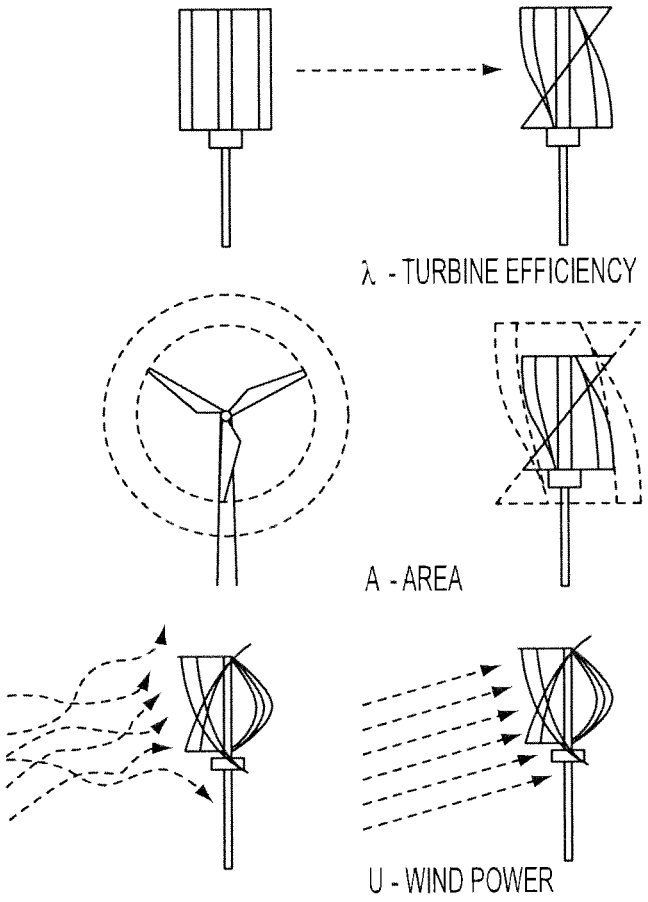
FIG. 30 provides a diagram showing strategies to increase building-integrated wind turbine power output in one embodiment.

In one embodiment, pressure differences arising from the wind may be channeled through the building and released at at least one desirable and/or predetermined location. For example, as shown in FIG. 29 (top left diagram), the channeling of wind hitting the envelope of the building (high pressure) to zones where there is low pressure may cause the flow to separate from the building. By channeling between zones of high pressure air flow to low pressure zones, the flow that separates (due to the low pressure) may be modified and/or controlled. In one embodiment, this method may be employed to reduce flow separation at the edges of a building.

During modification, the generated first air flow may be applied to the second air flow at an angle, such as to generate a third air flow different from the second air flow. Alternatively, as described above, the second air flow may cease to exist and the modified air flow may be different from the second air flow. The angles may be of any values, including any positive or negative values. For example, the angles may range between 0° (being parallel to the direction of the air flow) and 90° (being perpendicular to the air flow).

The modification of the air flow may be monitored and controlled. The monitoring and/or controlling may involve at least one monitoring and/or control system. The system may be, for example, a closed loop control system. The closed loop control system may comprise one or more sensors, one or more controllers, and/or one or more actuators. FIG. 29 provides a diagram showing resources and techniques that may be employed to control flow patterns around buildings in one embodiment. The control and monitor system may be controlled by at least a computer system configured to provide the control/monitor function. The control/monitor function may be executed by a software comprising an algorithm installed in a non-transitory computer readable medium. When executed, the algorithm of the software may monitor and/or control the system as programmed.

Apparatus

Provided in one embodiment is one apparatus that may be configured modify an air flow at at least one location of a building structure. The apparatus may be configured to alter a contour of at least one dimension of the building structure. The dimension may refer to height, width, depth, etc., depending on the context. Alternatively, the apparatus may be configured not to alter a contour of any dimension of the building structure. In one embodiment, the apparatus may modify the air flow profile around the building without changing the geometry at the building itself. The apparatus may be configured to perform any of the modifications of air flow as described above.

Figure 21:
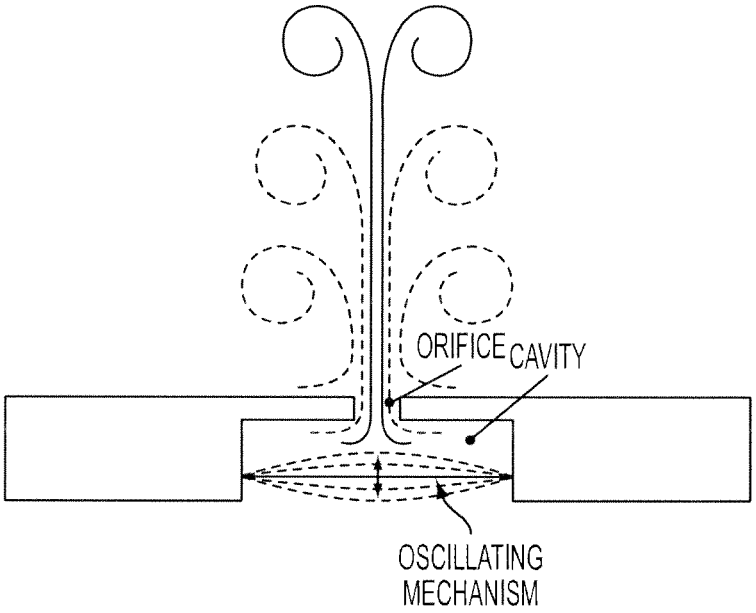
FIG. 21 provides a schematic showing a device generating a synthetic air jet in one embodiment.
Figure 34:
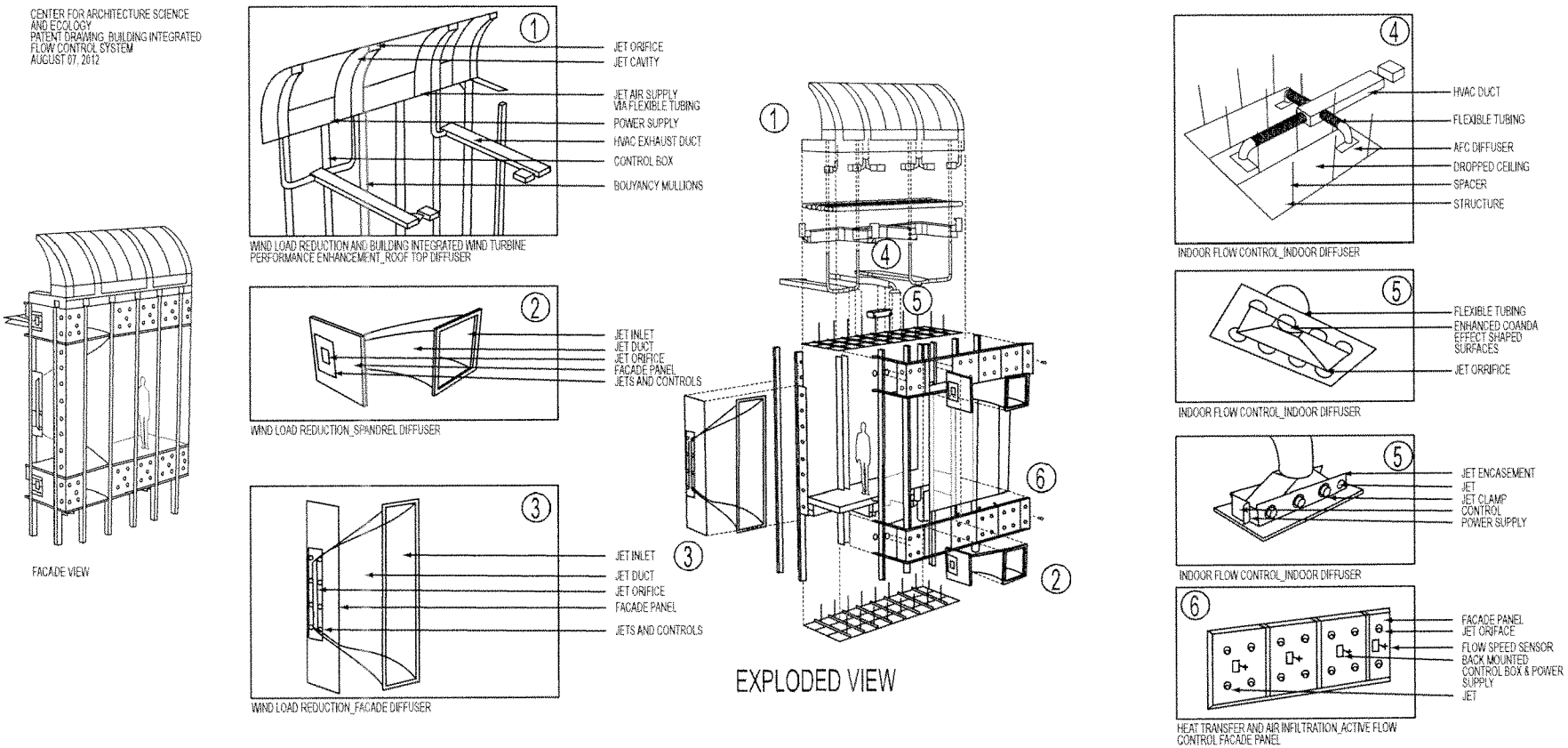
FIG. 34 provides a schematic showing several components of an integrated system described in one embodiment of BIHFCS.

In one embodiment, the apparatus may comprise an apparatus housing and a flow generator in the housing, the flow generator configured to generate a first air flow at the at least one location. The generated first air flow may modify a second air flow exterior to the building structure. The apparatus may be located at any of the locations as described above. The apparatus may comprise a device that is configured to generate a synthetic air jet, as shown in FIG. 21 in one embodiment. For example, the apparatus may be located at an edge of the building structure. For example, the location(s) where the air flow is modified may comprise at least one of a side of the building, a top of the building, and a location integrated into the building envelope. In one alternative embodiment, the apparatus may be located at a different location from location(s) wherein the flow is modified. In one embodiment, the apparatus housing is at least one of (i) mounted on and (ii) integrated into an edge of the building structure. In one embodiment, the generated first air flow may exit the apparatus housing at an angle to the second air flow. The apparatus may be a part of an integrated system, such as a BIHFCS as shown in FIG. 34, which is described in more detail below.

The apparatus may further comprise a device configured to generate the first air flow. The device may comprise any of the mechanical systems and devices as described above. In one embodiment, the apparatus may further comprise at least one suction port, wherein the generated first air flow comprises a suction flow applied to the second air flow using the at least one suction port. The sucking part may provide passive suction and/or active suction.

Building

Figure 20:
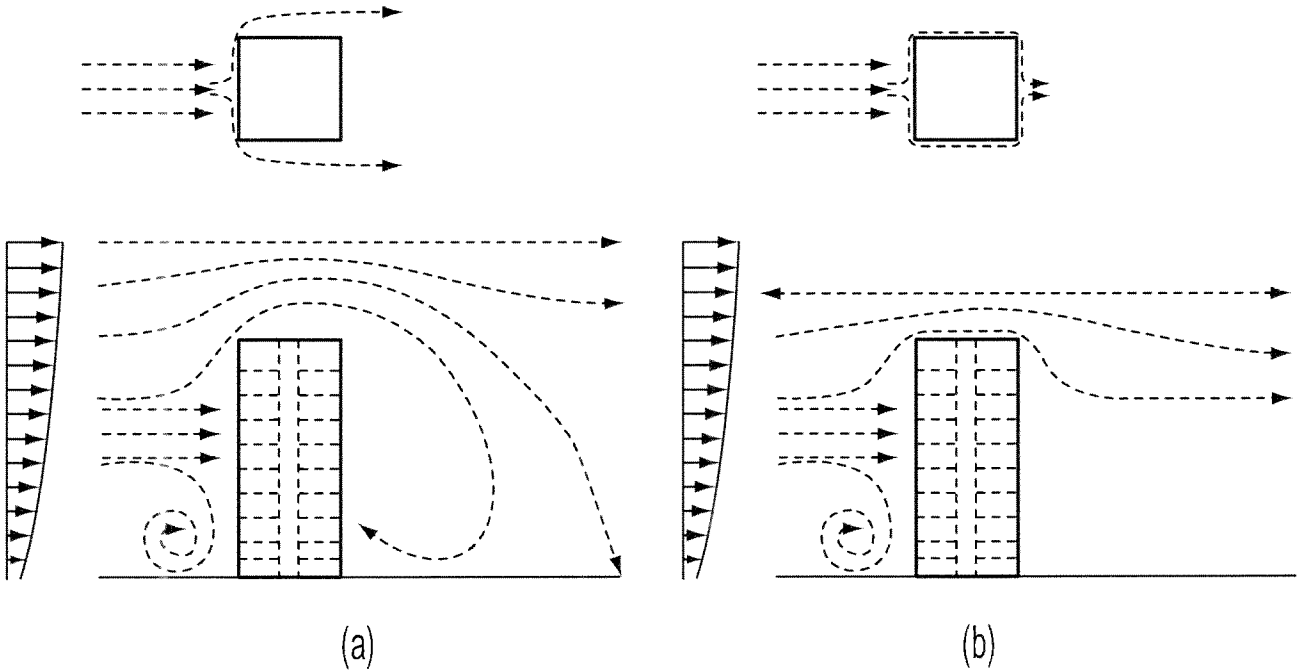
FIGS. 20(*a*)-20(*b*) illustrate a contrast between (a) simplified flow patterns around a rectangular building, and (b) flow pattern around a building with an integrated flow control system in one embodiment.

Provided in another embodiment is a building structure comprising the apparatuses described herein. In one embodiment, the building structure may comprise an apparatus at at least one location of the building structure, the apparatus comprising: an apparatus housing; and a flow generator in the housing, the flow generator configured to generate a first air flow at the at least one location. The generated first air flow modifies a second air flow exterior to the building structure at the at least one location of the building structure. FIGS. 14-17 show the effect of active air flow control on the air profile around a model building block in a smoke visualization test in one embodiment. FIGS. 20(*a*)-20(*b*) illustrate a contrast between the flow patterns around a regular building and a building with an integrated flow control system in a simplified model illustration. Also, FIGS. 25(*a*)-25(*b*), respectively, show velocity vector fields of inlet ducts with and without active fluid control for separation mitigation in one embodiment.

The building structure may comprise a power generating device configured to generate electrical power using at least the modified second air flow. The power generating device may comprise a wind/gas turbine and any other instrument needed to generate power from wind. The wind turbine may be located at any of the locations where the air flow is modified as described above. For example, the turbines may be located at the top of the building structure. FIGS. 30-44 show several embodiments in which wind is harvested at a rooftop to generate power. In one embodiment, the building structure may comprise an air filtration system configured to filter air in an interior of the building structure using at least the modified second air flow. In another embodiment, the building structure may comprise a heat transfer system configured to exchange heat between an interior and the exterior of the building structure using at least the modified second air flow.

Applications

The modified air flow may be used for a variety of applications. In one embodiment, the modified air flow may be used to generate power at the building structure. The power may be electrical power, heat power, etc. For example, the modified air may be able to amplify the air flow to cause at least one turbine to rotate to generate electrical power. In one embodiment, depending on the location, the power may be generated inside or outside of the building structure. The power generated may be fed to be used within the building or may be fed back to the electrical grid.

The systems (including the apparatuses) and the methods provided herein may be employed in a variety of applications. In one embodiment, they may be employed to control air filtration at the building envelope. In one embodiment, to control the air filtration, sensors may be located in the building envelope and measure interior and exterior pressure. When the pressure difference between the two sides of the envelope is large, a flow of air (jet) may be released from the building to change the flow around the building. Thus, in this embodiment, once the pressure difference is equalized, air release may stop.

Figure 23:
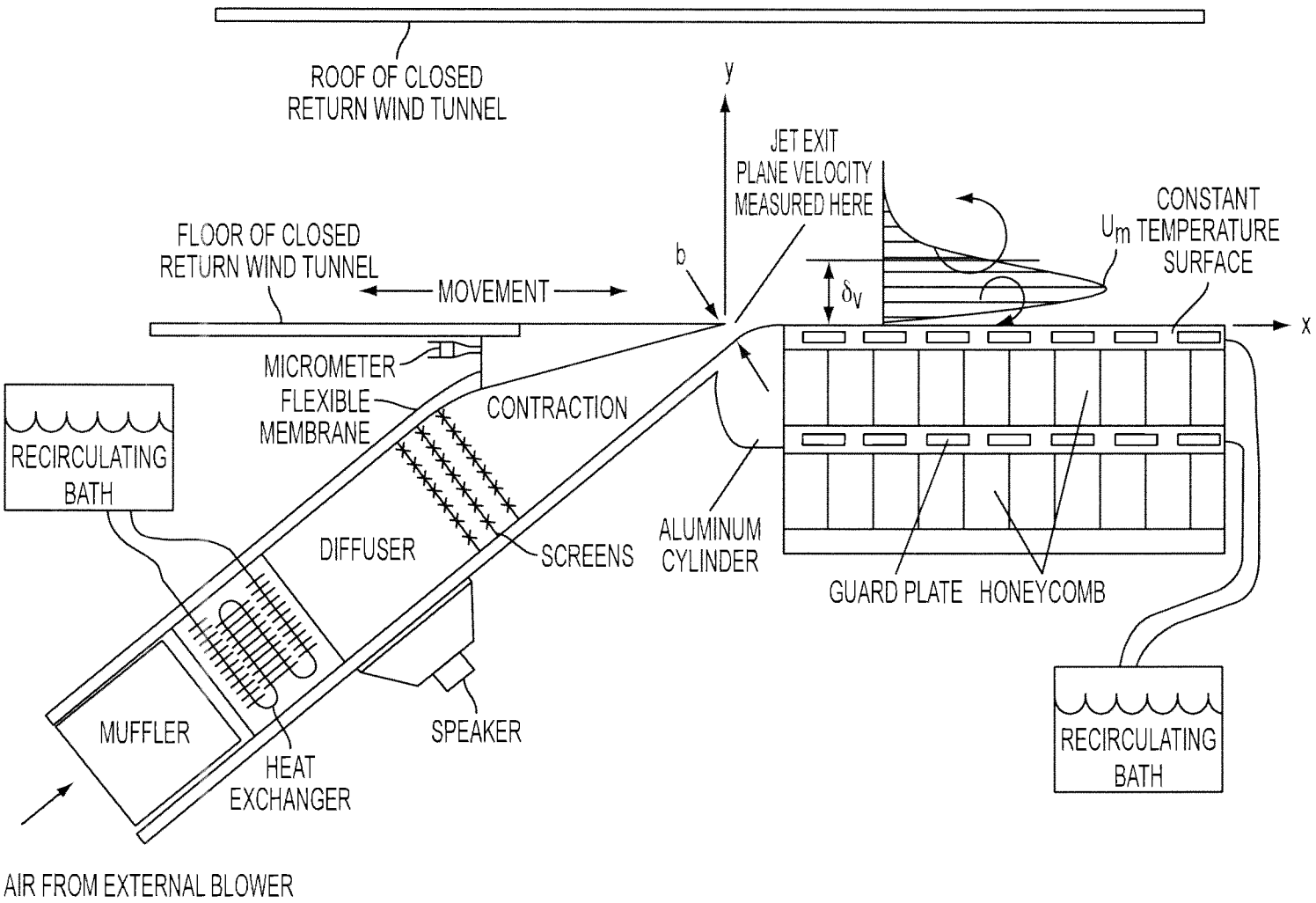
FIG. 23 provides a schematic showing a diffuser with integrated synthetic jets in one embodiment.
Figure 24:
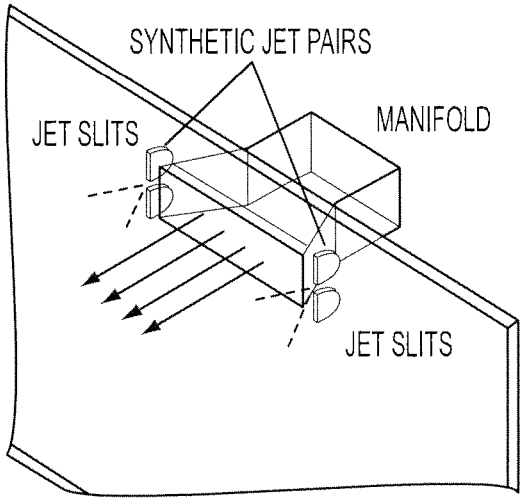
FIG. 24 provides a schematic showing a diffuser with integrated synthetic jets in another embodiment.
Figure 24:
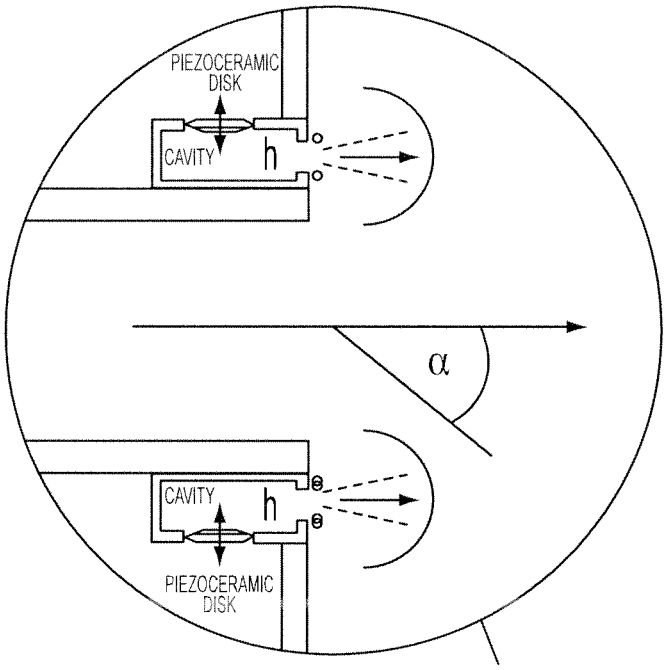

In another embodiment, the systems and method herein may be employed to control indoor flow distribution inside of a building structure. For example, the system may include, or is, an integrated flow control device (e.g., active diffuser) for the delivery assembly/system of HVAC. A diffuser with integrated synthetic jets is shown in FIG. 23 and FIG. 24 in two alternative embodiments. The active diffuser may be configured to optimize indoor air flow characteristics such as the jet throw, its ceiling attachment and separation location, and its trajectory for full and reduced flow rates.

Figure 19:
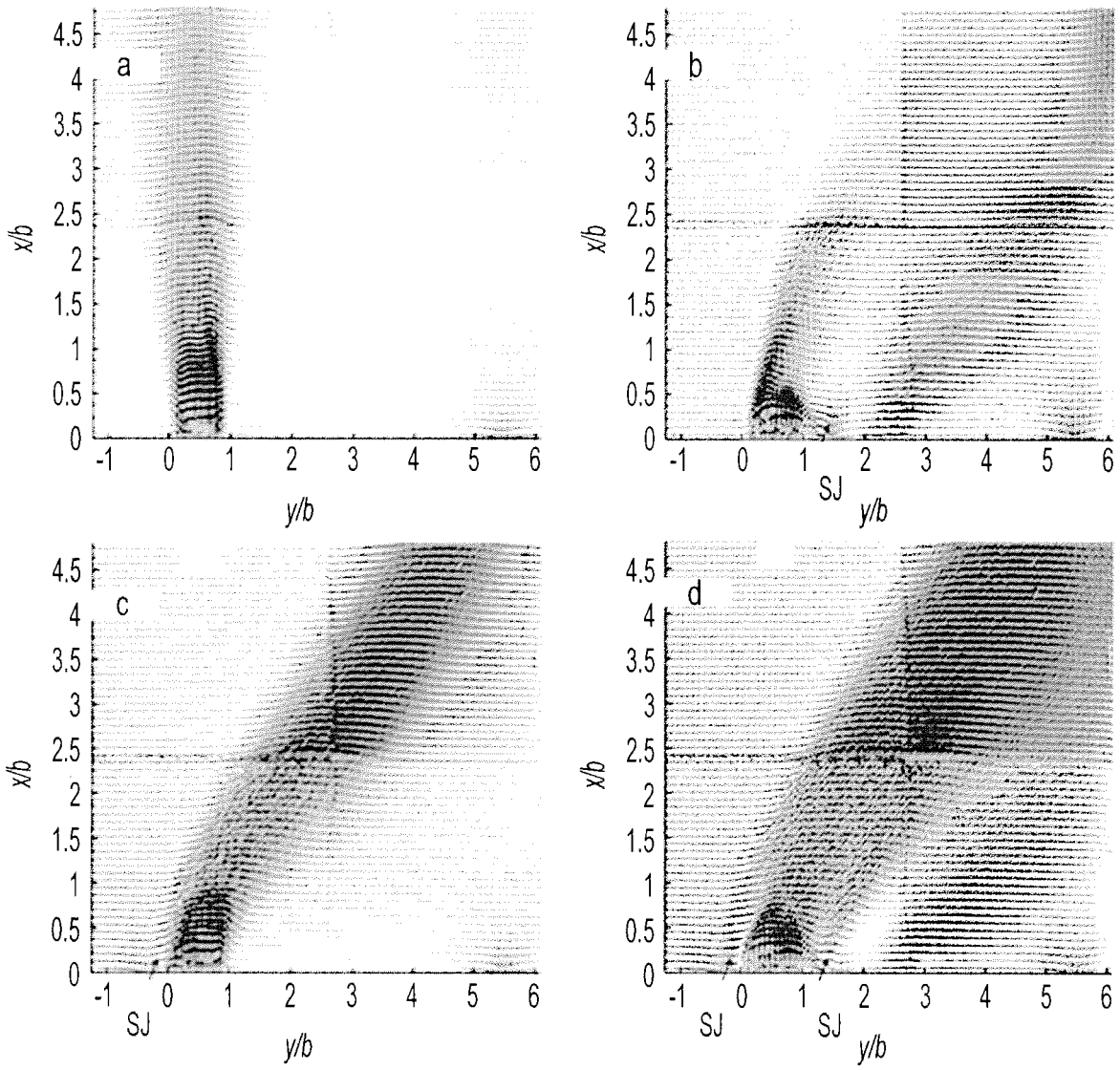
FIG. 19 provides a global view of the velocity vector fields of the aerosol plume at 40 lpm in one embodiment for (a) baseline, and the synthetic jets activated with D4 ¼ 150 in (b) pull mode, (c) push mode, and (d) pull pushmode.

In another embodiment, the systems and methods herein may be employed to control aerosol dispersion and removal in a confined space, such as inside a building. For example, the system may include an integrated flow control device and sensor array for integration into the indoor environment. The system may be employed to vector and guide aerosol plumes into designated vents that remove the aerosols from the overall air circulation system to a designated container rather than being exhausted back into the environment. Referring to FIGS. 19(*a*)-19(*b*), the figures provide a global view of the velocity vector fields of an aerosol flume at 40 lpm in different modes.

Figure 26:
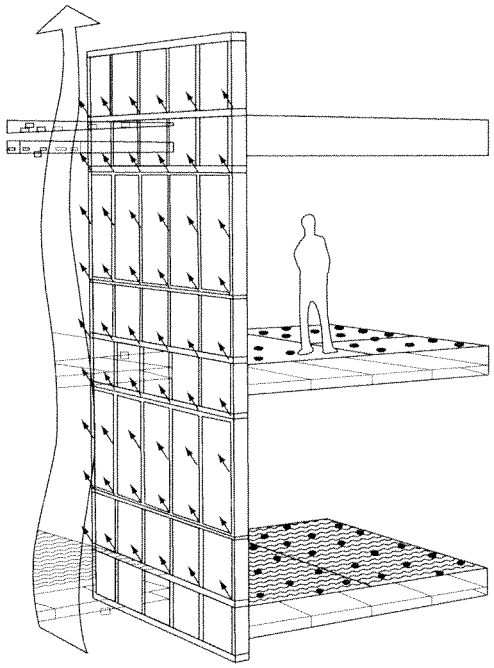
FIG. 26 provides a schematic showing an axonometric view of a building envelope comprising active control actuators in one embodiment to control heat transfer at the building envelope to balance fluctuating climate conditions and indoor mechanical environment.
Figure 27:
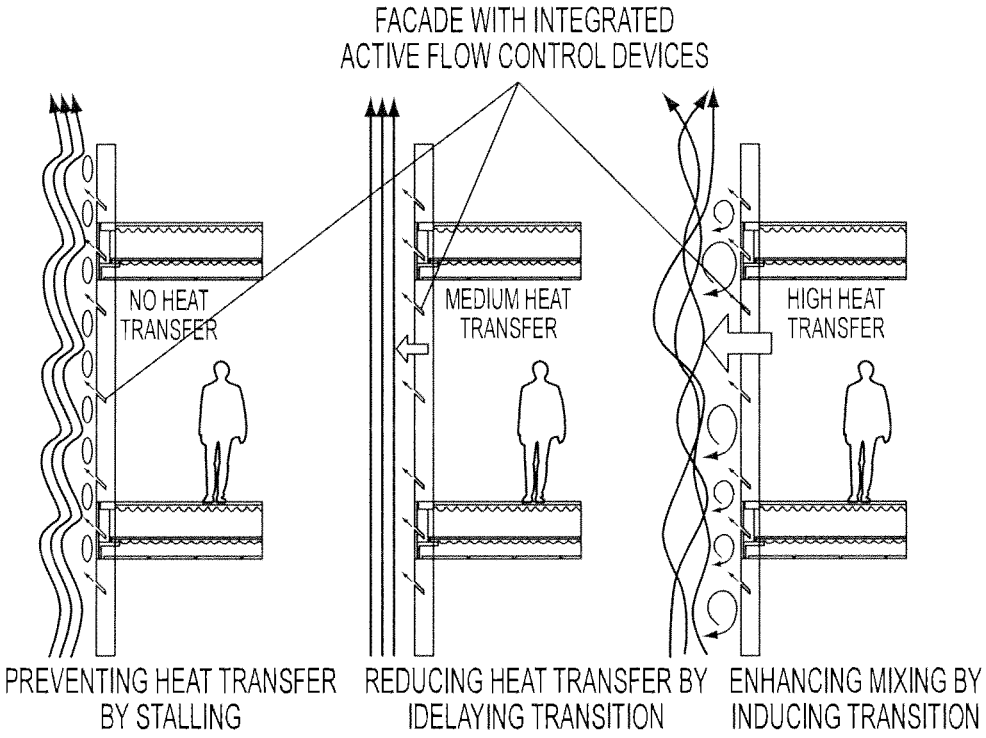
FIG. 27 provides a schematic showing an impact of the system in one embodiment on heat transfer at the building envelope.
Figure 28:
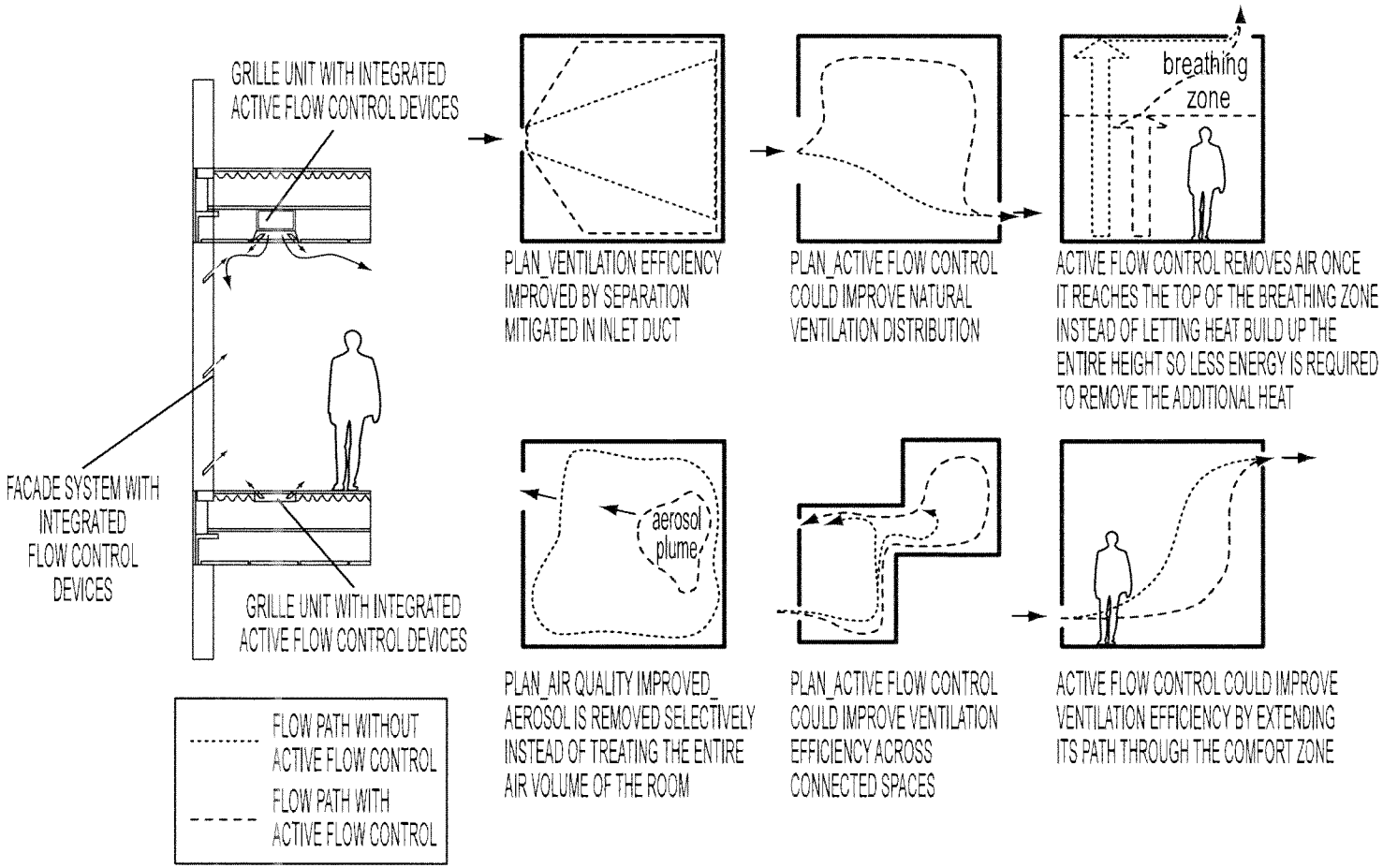
FIG. 28 illustrates the impact of one embodiment of the present apparatus and method in the interior application in one embodiment.

In another embodiment, the systems and methods herein may be employed to control heat transfer at the building envelope. In one embodiment, the heat transfer may be controlled by having sensors located in the building envelope to measure interior and exterior temperatures. Based on the temperature difference between both sides of the envelope and the desired temperature management strategy, a flow of air (jet) may be released from the building to change the flow around the building to increase/decrease/maintain heat transferring. Thus, in this embodiment, once the temperature difference or targeted heat transfer rate are met, air release may stop. FIG. 26 provides a schematic showing an axonometric view of a building envelope comprising active control actuators to control heat transfer at the building envelope to balance fluctuating climate conditions and indoor mechanical environment. FIGS. 27-28 further demonstrate the impact of the apparatus and method described herein on the interior of the building structure in different embodiments.

In another embodiment, the systems and methods herein may be employed to reduce wind load and/or cross wind response on building structures. For example, the system may include a responsive building envelope integrated flow control device for active damping for the displacement of fluidic flow around buildings. The system may use fluidic actuators with or without envelope integrated surface morphology modifications using synthetic jets and/or in tandem with untapped resources—e.g., air flows induced by atmospheric, thermal (stack), and/or mechanical (HVAC) pressure differences to reduce wind induced forces (i.e., cross wind response and acceleration) on buildings and tall structures. In one embodiment, to reduce wind loads on the building structure, sensors may be employed and located on the building to measure structure response (mean and resonant) to wind loads. Based on the sensor input, air flows (jets) may be released from the building at various locations to change the flow around the building in order to decrease wind loads and building dynamic response. Once the building response is brought into a desired range, the jets may stop.

In another embodiment, the systems and methods herein may be employed to augment power generated by building integrated wind turbines. For example, the system may include a responsive building envelope integrated flow control device for significantly increasing yield (power output) of building integrated wind ("BOW") devices by virtually modifying the building surface with or without envelope integrated surface morphology modifications using synthetic jets and/or in tandem with untapped resources—e.g., air flows induced by atmospheric, thermal (stack) and mechanical (HVAC) pressure differences to reduce wind induced forces (i.e., cross wind response and acceleration) on buildings and tall structures. In one embodiment, to augment power generated by building integrated wind turbines, actuators may be employed and located next to the turbines, either in the building envelope or as an independent apparatus to modify the aerodynamic performance level of the building to improve the quality of air flow that feeds the turbines. Air flow may be released to change the flow that feeds the wind turbines.

FIGS. 30-33 show various embodiments in which active fluid control systems described herein are employed to harvest the wind to generate power. FIGS. 31(*a*)-31(*c*) provide schematics showing manipulating wind flow with an active control system at rooftop condition in another embodiment; (a) shows using BIHFCS for vertical wind turbine configuration; (b) shows using BIHFCS for horizontal wind turbine configuration; and (c) shows using BIHFCS for stacked horizontal wind turbine configuration. In this embodiment, FIGS. 31(*a*)-31(*c*) demonstrate that the apparatus is not limited to a specific wind turbine type and is applicable to horizontal, stack of horizontal turbines, a combination thereof, as well as other types.

NON-LIMITING WORKING EXAMPLES

Example 1

Aerodynamic Performance of Building

The development and increasing use of light-weight and high-strength materials in the construction of tall buildings, offering greater flexibility and reduced damping, has increased tall building susceptibility to dynamic wind load effects that limit the gains afforded by incorporating these new materials. One risk associated therewith is resonant oscillations induced by von-Kármán-like vortex shedding at or near the natural frequency of the structure caused by flow separation. The effects of dynamic wind loading increase proportionally with the power of the wind, causing tall buildings to pay a significant material price to increase the natural frequency and/or provide damping. In particular, crosswind response often governs both the strength and serviceability (human habitability) design criteria.

While both SAM and GAM strategies have merit, they often come at the expense of reduced valuable leasable area and high construction costs, due to increased structural demand for mass and stiffness, further contributing towards the high consumption of non-renewable resources by the building sector. Therefore, a traditional aerodynamic based solution may come at the cost of habitable, and therefore valuable, floor area that, in turn, may need additional compensatory stories, which further increase the wind loads and construction costs.

Figure 1:
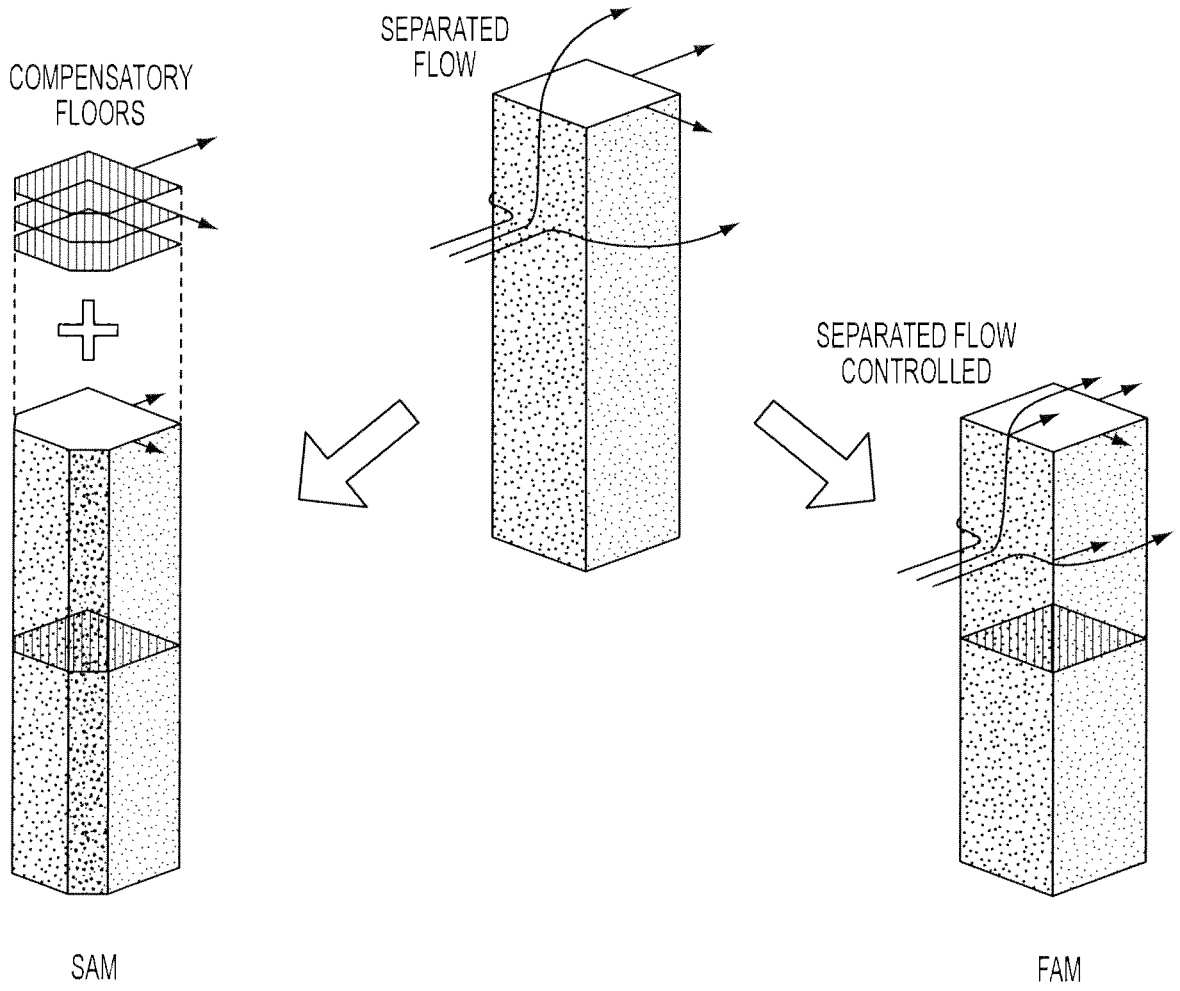
FIG. 1 provides a schematic diagram showing a comparison of SAM and Fluid-based Aerodynamic Modification ("FAM") in one embodiment.
Figure 2:
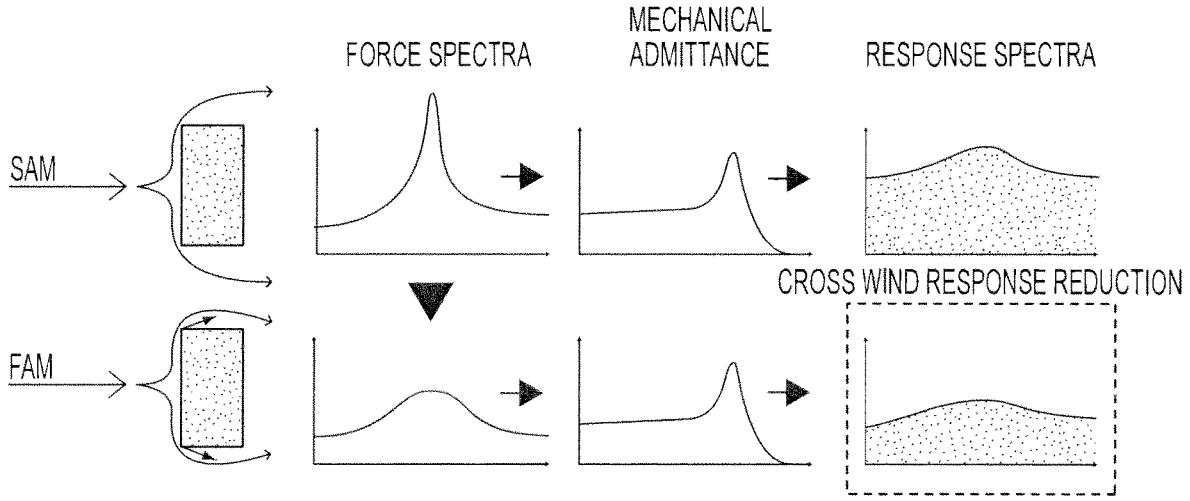
FIG. 2 provides a schematic diagram showing that: by affecting the crosswind force spectra on the building through the manipulation of the boundary layer, the desired damping may be achieved using fluid in one embodiment.

While the SAM approach relies on the building, its geometry and material properties for aerodynamic performance, the proposed Fluid-based Aerodynamic Modification ("FAM") approach is different. FIG. 1 provides a schematic diagram showing a comparison of SAM and FAM in one embodiment. FIG. 1 shows that SAM physically modifies the baseline building plan to reduce wind loads thus needing additional compensatory stories; whereas FAM controls airflow while preserving the baseline plan for economic optimization and maintenance of optimal Floor Area Ratio ("FAR") in one embodiment. Instead of adjusting the solid material to improve the aerodynamic shape of the structure, fluid-based flow control is used to manipulate the boundary layer characteristics (see FIG. 1), i.e. the interaction domain between the building and the airflow, such that the airflow virtually "sees" a different shape. FAM is an active flow control ("AFC") strategy—i.e., a strategy that utilizes a power input and alters the flow only when desired. As shown in FIG. 2, one goal of the systems and methods herein is to mitigate flow separation in order to reduce the impact of shed vortices, reduce wind loading and decrease pressure fluctuations across the building envelope. FIG. 2 shows reducing the mechanical damping requirements of the building's structure to achieve the desired serviceability criteria in one embodiment. The FAM approach relies on concepts developed for boundary layer control ("BLC"), and its application to date has been mainly in the aviation industry. However, the application thereof to bluff bodies (buildings) in highly turbulent flow and the impact on fluctuating loads has not been investigated in the past. In one embodiment, two strategies for BLC may be employed:

1. Steady forcing: aerodynamic performance modification using steady flow

Boundary layer control to prevent separation has traditionally been associated with the steady addition (blowing) of high momentum fluid, or the removal (suction) of decelerated fluid near a surface from a boundary layer to deflect the high-momentum free-stream fluid towards the surface.

Figure 3:
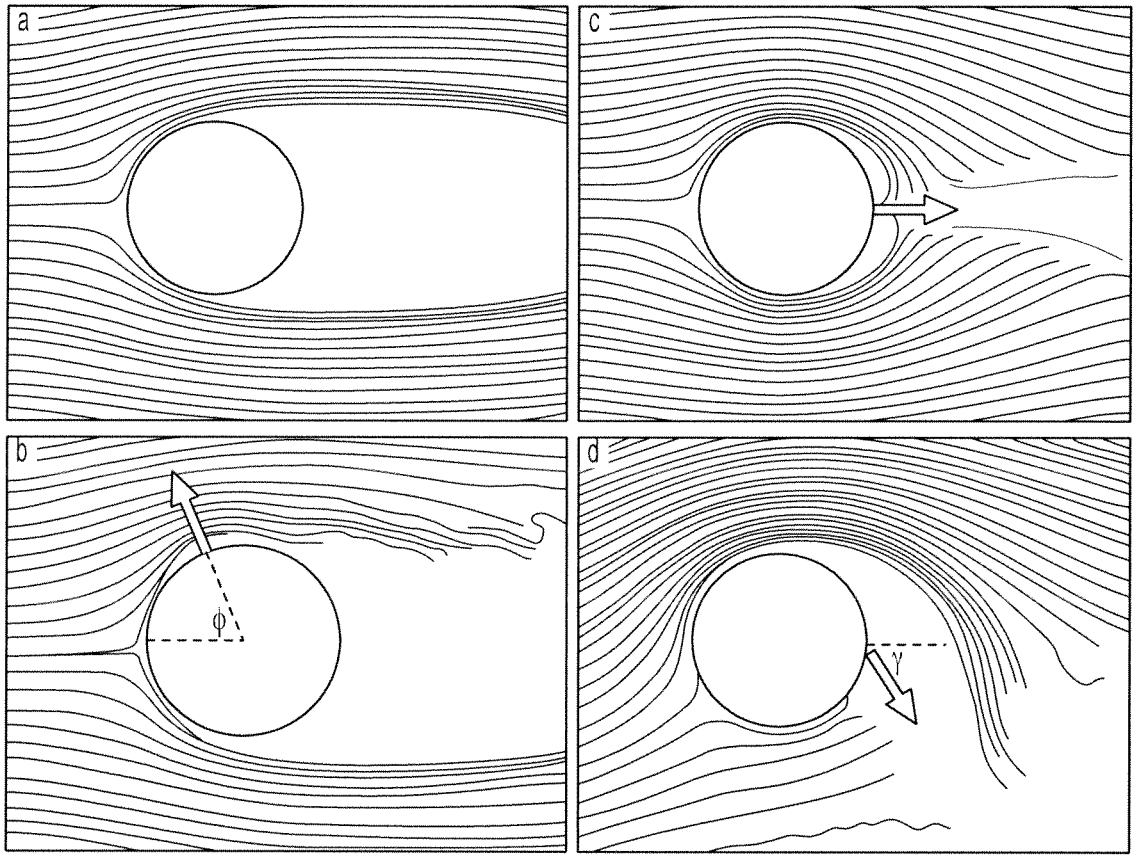
FIG. 3 illustrates smoke flow visualization in one embodiment: (a) baseline, (b) actuated $\gamma=60°$, (c) $\gamma=180°$, and (d) $\gamma=180°$ and $\theta=120°$.
Figure 22:
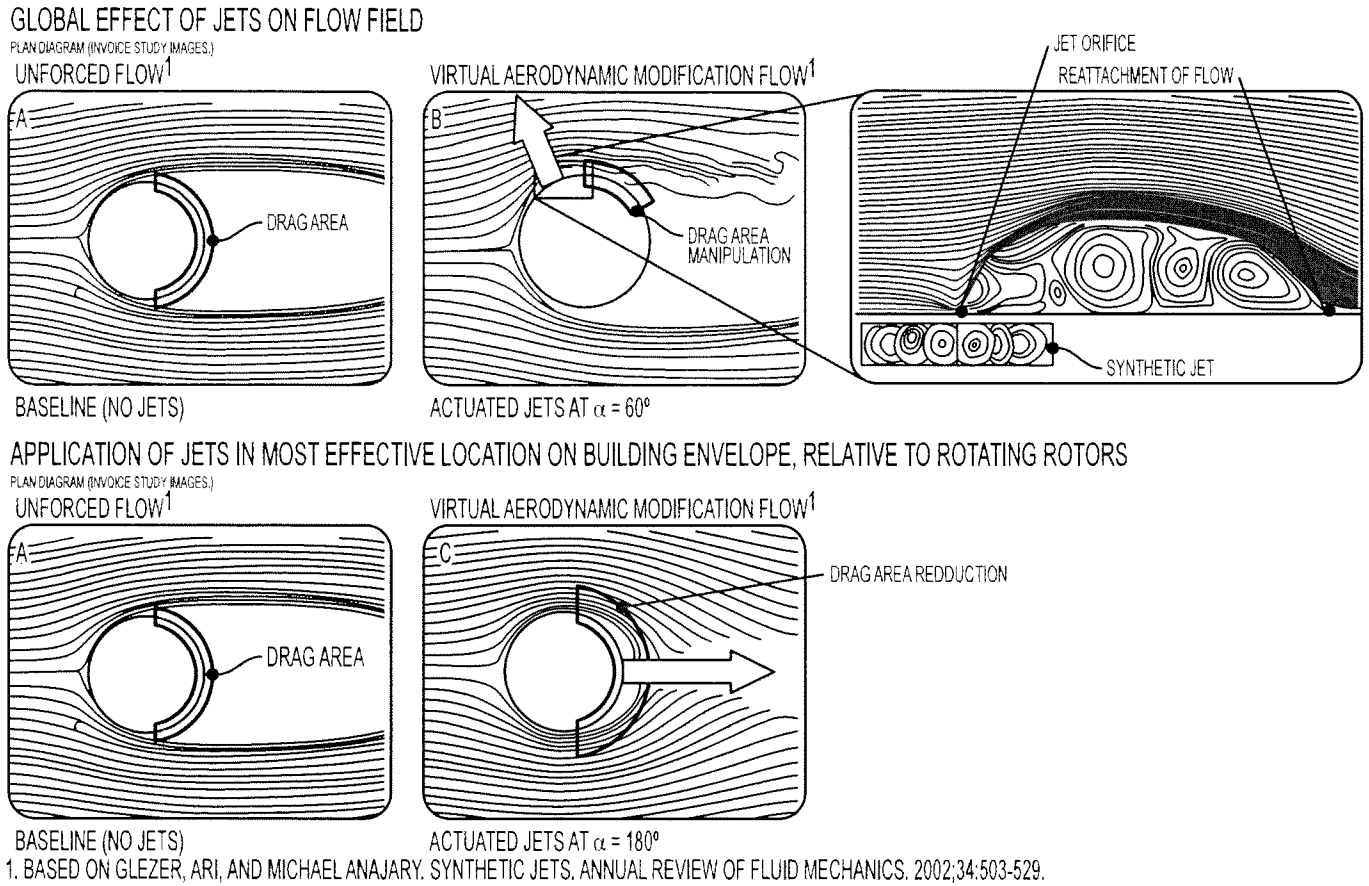
FIG. 22 provides a schematic showing flow visualization in one embodiment showing interactions between synthetic jets and flow field around a cylinder model.

2. Unsteady forcing: aerodynamic performance modification using periodic excitation The second, more recent and more energy efficient approach, is periodic excitation, often regarded as oscillatory addition of momentum. As opposed to the steady flow strategy, which seeks to simply add or remove momentum to the flow, periodic excitation takes advantage of knowledge of naturally occurring frequencies within the flow and structures associated with them. Therefore, periodic excitation may be used to alter more effectively than the steady characteristics of the flow by targeting the structures. Additionally, with a sufficiently high actuation frequency, it may be possible to achieve virtual shaping of the object, where the flow effectively sees a different shape. See FIG. 3. An alternative illustration of flow visualization in one embodiment showing interactions between synthetic jets and flow field around a cylinder model is shown in FIG. 22.

Although unsteady forcing is more complex than steady forcing, the former has three main advantages over the latter: power needed is an order of magnitude smaller, actuators can be decoupled from a main propulsive system, and they are autonomous, small, and light-weight. Synthetic jets, which neither add nor subtract mass from the flow field (i.e., zero-net mass flux), are used as periodic excitation actuators in the present work. These actuators operate by the periodic motion of a diaphragm that is (typically) driven by a piezoelectric disc.

The addition of momentum by forcing is generally quantified using the blowing ratio, $C_b$.

$$C_b = \frac{U_j}{U\infty} \tag{1}$$

Where $U_j$ is the jet velocity and $U_\infty$ is the free-stream velocity and the momentum coefficient, $C_\mu$:

$$C_\mu = \frac{\rho_j U_j^2 bh}{\rho_\infty U_\infty^2 DH} \tag{2}$$

Where $\rho_j$ and $\rho_\mu$ are the densities of the jet and the free-stream velocity, respectively. $U_j$ and $U_\infty$ are the jet and free-stream velocities. D, H, b, h are the model width, height and jet orifice width and height, respectively.

Experimental Work

Tests were conducted in an open-return low-speed wind tunnel. The wind tunnel had a test section with a 0.8×0.8 meter cross-section and was 5 meters long with a maximum speed of 50 m/s and a turbulence level of less than 0.2%. The tests were conducted in uniform flow conditions. Although tall buildings are immersed in the atmospheric boundary layer and exposed to non-uniform mean velocity and turbulence intensity profiles, uniform flow becomes more relevant the taller the building is. The experiment conducted here aimed to investigate FAM on bluff body separation without the added complication of a turbulent boundary later.

Studies ranged from the physical testing of the interaction between forcing and cross flow, through their implication on the aerodynamic performance of various bluff bodies, to a framework integrating aerodynamic performance parameters alongside architectural parameters to evaluate impact on overall building performance.

A Feasibility Study Applying FAM Using Steady Forcing on Top of a Prism

An experiment was set up to investigate the effect of steady and unsteady forcing on flow across the top of a prism—in this section only the steady forcing is discussed.

Set Up: a prism with an aspect ratio of 1:1:3 was tested in a wind tunnel facility at RPI. Pressure measurements were recorded at the top surface, where an array of steady jets was located near the windward edge. Tests were conducted at three different speeds ($U_\infty$=12, 18, and 24 m/s) with the jets supplied by a compressed air line at a range of flow rates (Q 10-70 L/min). The jet orifices were oriented such that the jets issued downstream at an angle of 20° with respect to the top surface of the prism.

Results: the tests demonstrated that applying forcing to the flow past the top of the prism affected the pressure distribution across the surface. The pressure coefficient (i.e. a non-dimensionalized measure of pressure) is defined as:

$$C_\rho = \frac{P - P_\infty}{\frac{1}{2}\rho_\infty U_\infty^2} \tag{3}$$

where P is the pressure measured on the surface of the prism, $P_\infty$ is the free-stream static pressure. More negative values of $C_\rho$ (for an attached flow) can be correlated to larger near-surface velocities.

Figure 4:
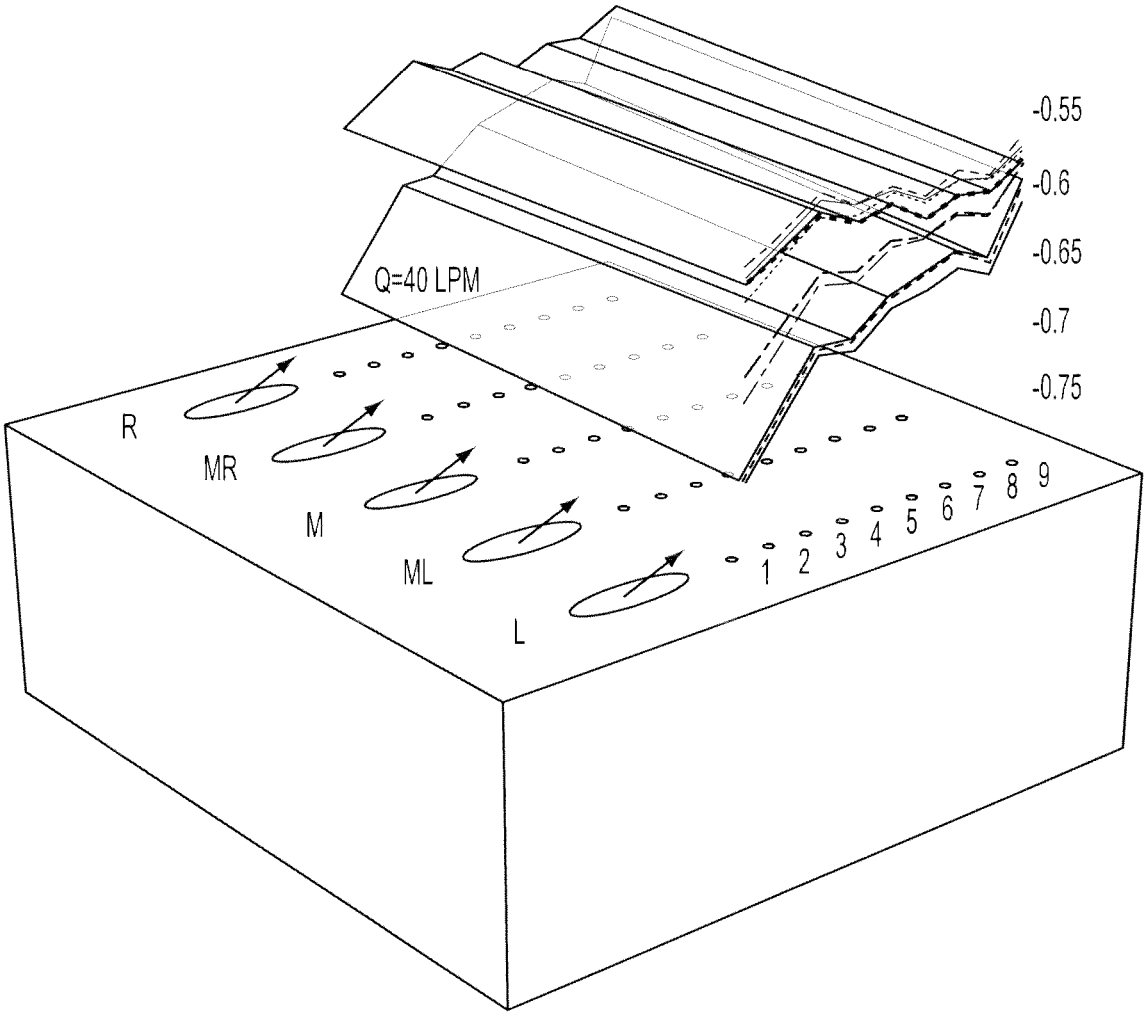
FIG. 4 provides a diagram of averaged pressure coefficient in one embodiment without (grey) and with forcing (orange), $U_\infty=12$ m/s.

Increases in flow rate resulted in (larger momentum addition) proportional decreases pressure coefficient (see FIG. 4), which suggests that the separated boundary layer was brought closer to the surface with the application of forcing.

Thus, not to be bound by any theory, but boundary layer separation control at the parapet of the building would result in the reduction of the structural penalty of elevating wind turbines above the separated region, which is typically done to avoid shear flow.

Example 2

A Comparative Study: FAM vs. GAM

Figure 5:
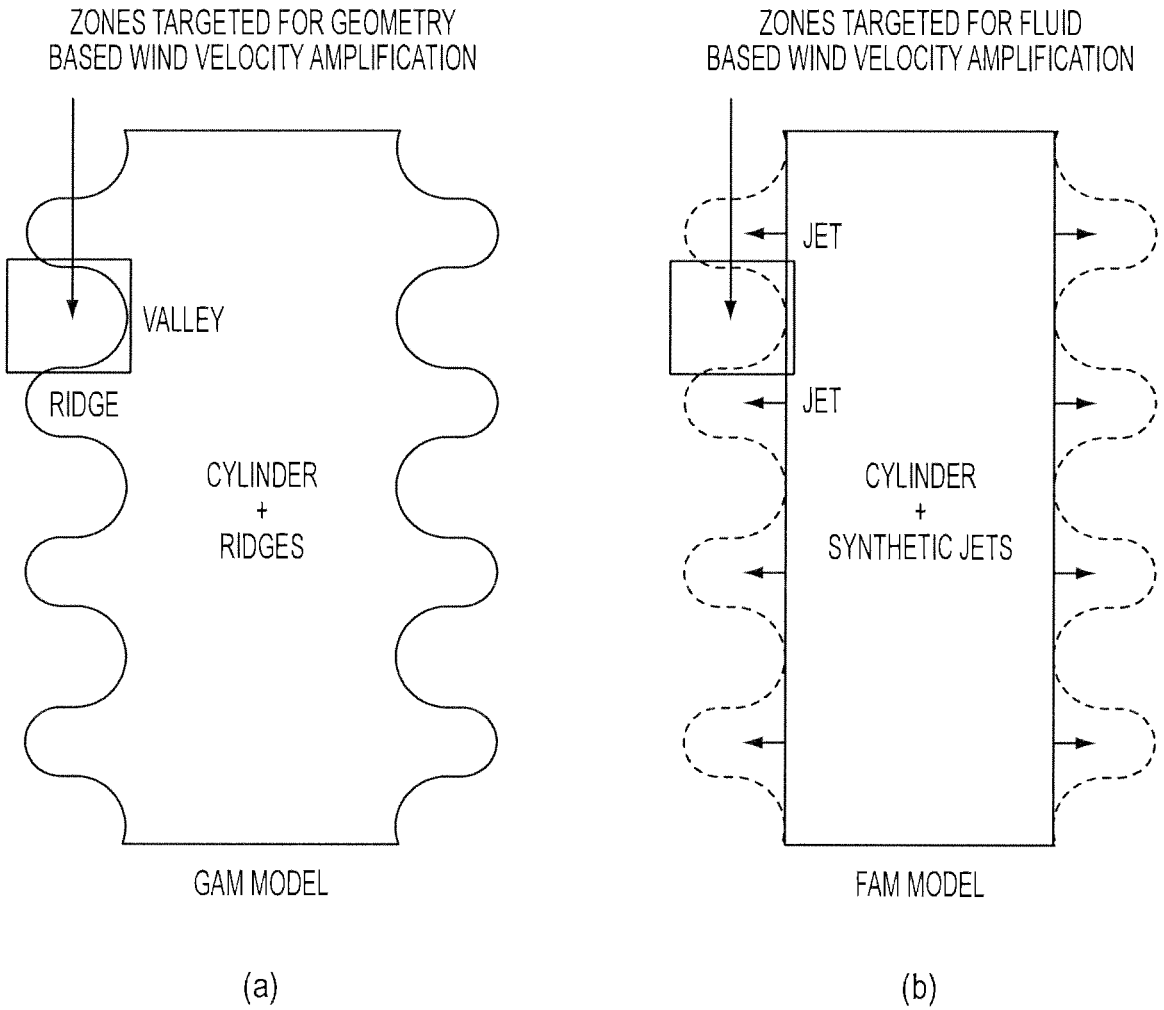
FIGS. 5(*a*)-5(*b*) provide schematic diagrams showing a cylinder in one embodiment with (a) geometric modification and (b) fluidic modification and the result on the three-dimensional wind profile of these modifications.
Figure 6:
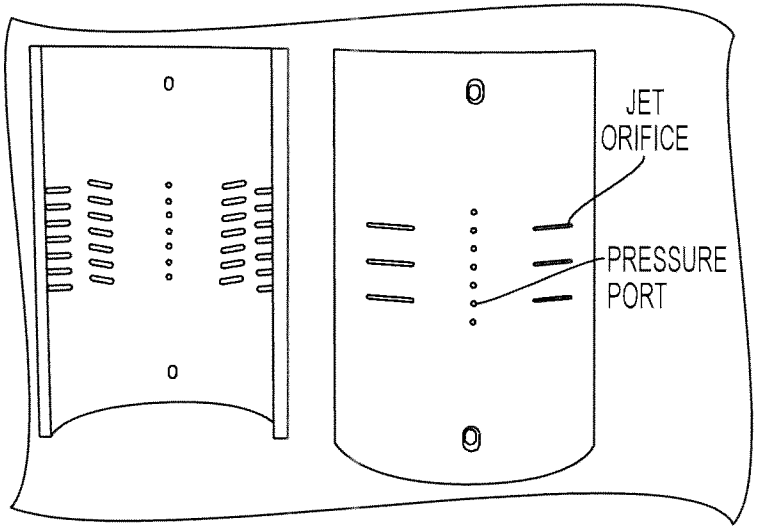
FIGS. 6(*a*)-6(*b*) illustrate photographs an FAM body with horizontal jet orifices and pressure port (a) and GAM body (b) in one embodiment
Figure 6:
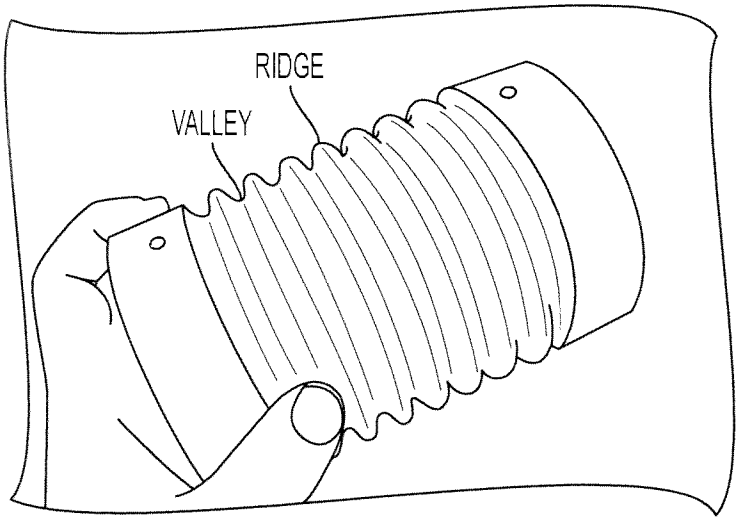

Referring to FIGS. 5-6, another experiment was conducted to demonstrate that a FAM body could achieve levels of flow amplification accomplished by a body that was geometrically modified ("GAM") without changing the shape of the original body. The GAM body drew on the wind amplified rotor platform ("WARP"). Due to the ability of the WARP to amplify wind velocity, its application to the building envelope or as a structure at the top of tall buildings has been of particular interest to architects. Unfortunately, due to its geometry, and the architectural and financial implications of floor area loss, building integrated wind turbines ("BUWT") integration in such a manner is not feasible.

Figure 11:
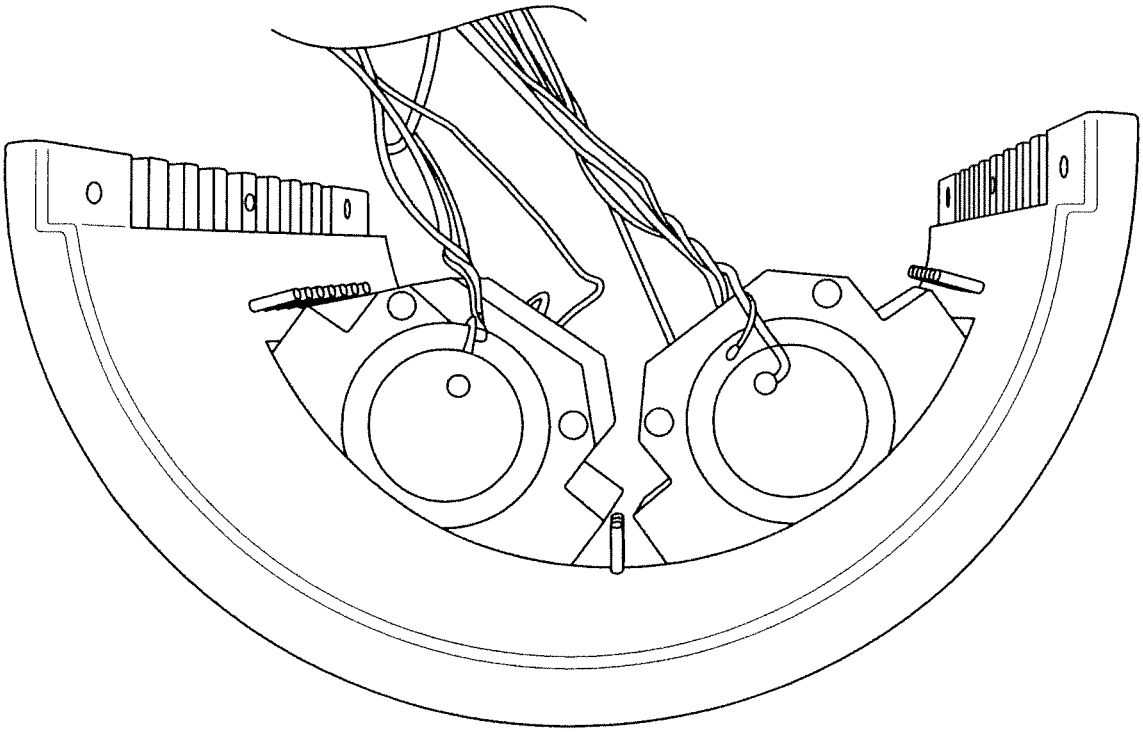
FIG. 11 illustrates an interior view of the cylinder model in one embodiment tested in the wind tunnel. The rounded discs are synthetic jets active fluid control ("AFC") actuators for providing synthetic jets; the actuators may be used to produce an unsteady jet that alters the flow that passes the body's surface with relatively very small energy investment in one embodiment.
Figure 18:
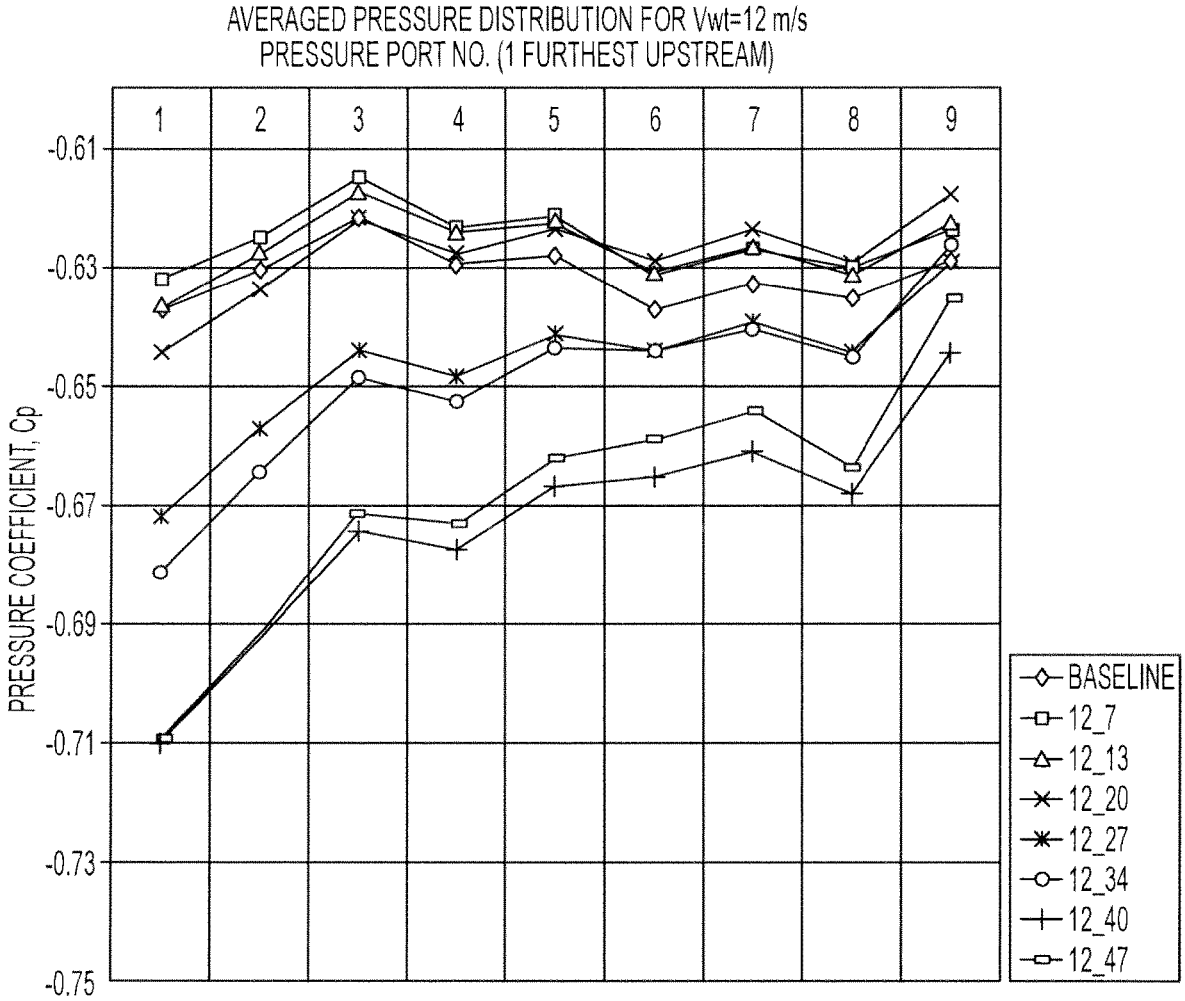
FIG. 18 illustrates a (non-normalized) graph showing a change in the flow rate of the jets in one embodiment. As seen in the graph, as the jets' flow rate increases the surface pressure decreases until it reaches, towards the leeward side of top of the model, the same values without jets being applied at all (indicated as base line in the legend).

Set Up: computational fluid dynamic ("CFD") simulations were conducted to integrate the design and measure the passive flow amplification of a WARP inspired GAM model. A series of wind tunnel experiments compared air velocity amplification by the GAM model (FIG. 6(*a*)) to a FAM model (FIG. 6(*b*)); the slots are the orifices of the jets and the holes are pressure ports for surface pressure measurements. FIG. 11 shows an interview view at the cylinder model tested in that wind tunnel. The FAM model was a circular cylinder Ø 101.6 millimeters, and an aspect ratio, AR=H/D=3 (i.e. low aspect ratio in order to maximize three-dimensionalities in the flow field). Tests were conducted at a free-stream velocity of 18 m/s, corresponding to a Reynolds number, based on diameter, of $1.17\times10^5$. FIG. 18 shows a non-normalized graph showing a change in the flow rate of the jets in one embodiment. The experiment was repeated for three different flow velocities.

Results: While the GAM model velocity amplification at the valleys was 16% (of the free stream velocity), the FAM model velocity amplification reached a 40% increase across the entire span of the model with little energy addition ($C_b$=0.6, $C_\mu$=0.0569%).

Thus, the application of FAM to buildings could yield higher velocity increases than geometry changes to the envelope to aid in building integrated wind turbines ("BUWT") without the loss of floor area seen through the GAM approach. The simulations and experiments ultimately culminated in the development of a parametric trade off model that integrated wind energy generation parameters with architectural ones for the management of the complex dependency between air flow characteristics, active and passive amplification, BUWT characteristics, building shape and energy demands.

A third experiment was conducted to investigate the three dimensional interaction between synthetic jets and the airflow around an FAM model with a free-end. The experiment was conducted because many previous studies regarding active flow control ignored the three-dimensionalities seen in many real world objects and their resulting three-dimensional flow fields which represent typical building scenarios.

Set Up: the change to the flow field due to three-dimensional forcing of the FAM model using synthetic jet actuators was investigated through surface pressure measurements. Variables investigated included the number of synthetic jets actuated, the angle of the jets with respect to the free-stream, and the blowing ratio of the jets. Synthetic jet orifices were located at three separate span wise locations (z/D=1.37, 1.5, and 1.63). Each orifice had a length, b=20.32 mm and a width, h=1 mm, and was oriented such that the orifice was parallel to the free-stream direction. Experiments were conducted with the center line of the synthetic jet placed at a variety of angles with respect to the free-stream velocity, at two blowing ratios, $C_b$=0.4, 0.6, and three different combinations of jets.

Figure 7:
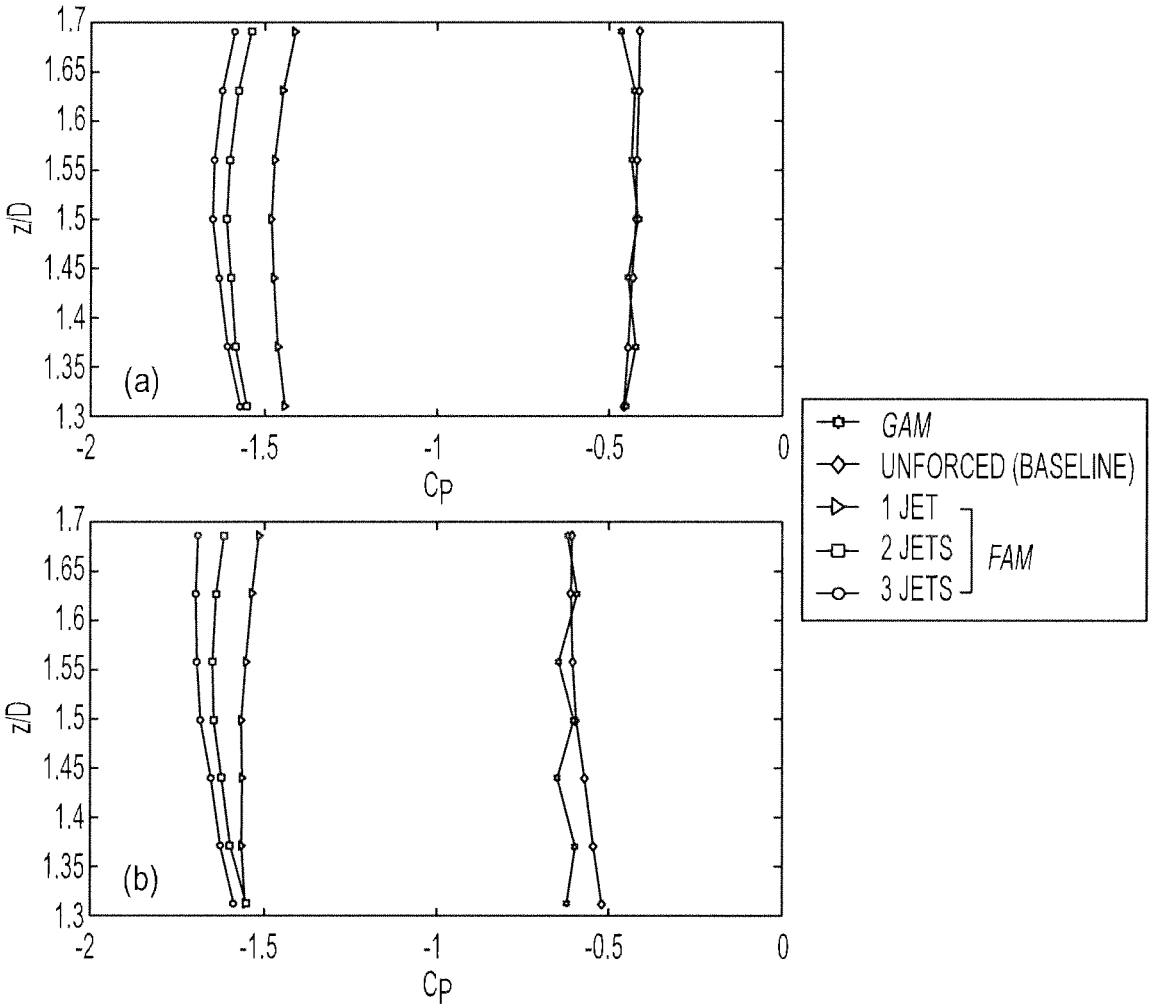
FIG. 7 illustrates a variation of the pressure coefficient as a function of span (near the location of the suction peak) for the FAM and GAM in one embodiment with the top fence (a) and without (b), $C_b=0.6$, $\theta_j=113°$, $\theta=75°$; where $\theta_j$ is the azimuthal location of the synthetic jet with respect to the free-stream velocity, and $\theta$ is the azimuthal location of the mode.
Figure 13:
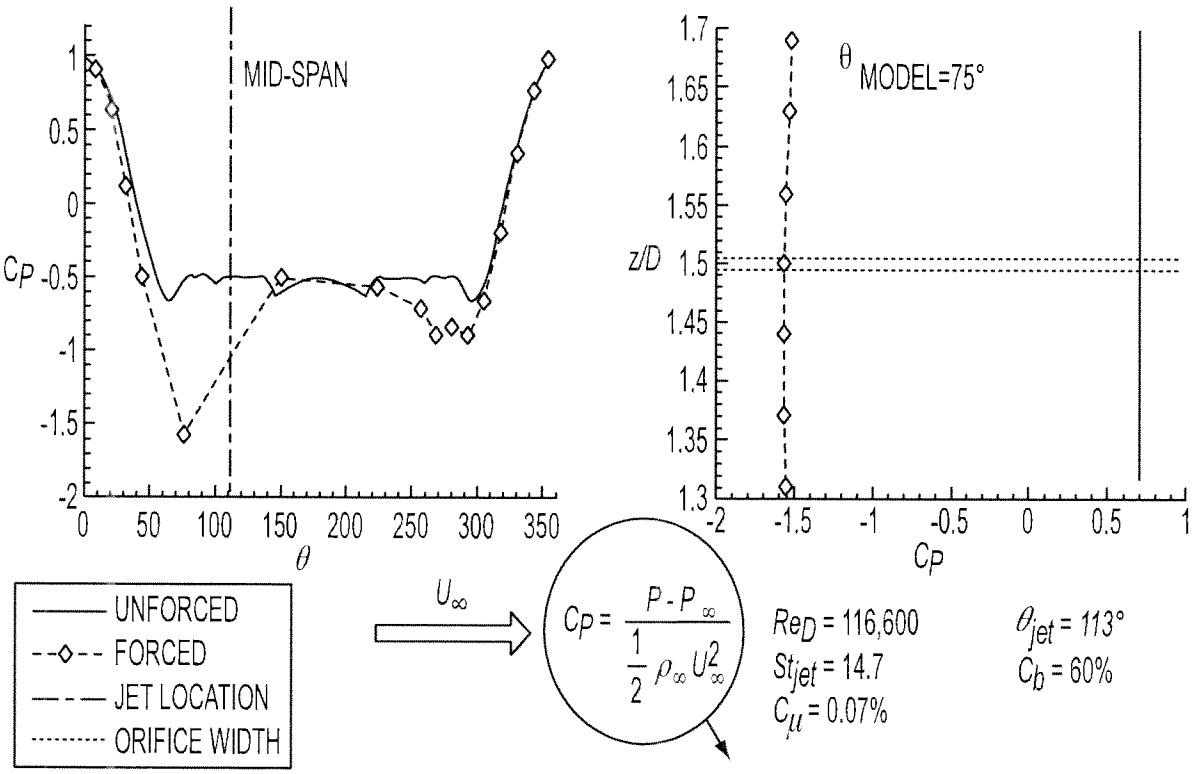
FIG. 13 illustrates that the jet was forced at a blowing ratio of 0.6, and at 113 degrees with respect to the free stream velocity in one embodiment; the graph on the left shows the azimuthal non-dimensionalized pressure distribution at mid span, as a function of angle, where the black line indicates the unforced case, and the blue diamonds are the result of forcing, with the red lines indicating the location of the synthetic jet.

Result: Referring to FIGS. 7 and 13, the downwash from the free-end created a unique flow field that responds differently to synthetic jet forcing than in a corresponding two-dimensional cylinder. The interaction of the synthetic jet with the downwash from the free-end resulted in a global change to the flow field about the FAM. The result of synthetic jet actuation was a reduction in drag, determined both from changes in the surface pressure distributions and a narrowing of the wake that persisted some distance downstream. The FAM was capable of achieving large decreases in $C_p$ much greater than both the unforced baseline case and the GAM case. As shown in FIG. 7, in all cases, the surface pressures were decreased, which indicates an acceleration of the near surface velocity.

Not to be bound by any theory, but due to the three dimensional nature of the flow around buildings, forcing at strategic locations can affect flow patterns on a larger scale along the span (height) of the building and downstream, disrupt the formation of shed vortex structures in the near wake, and reduce drag and structural vibrations.

Application

The practical application of FAM to tall buildings involves three issues:

Actuation: in order to achieve the desired effect on performance, fluidic actuators were incorporated into the building floor plan and their orifices integrated into the building's façade. In order to achieve significant results with the least energy investment, their vicinity to known separation points, mostly at the building's hard edges, is preferred. The orifice's design is mainly determined by the angle needed in which the flow is injected in order to affect low momentum areas in the separated region, and its dimensions by the flow rate available in relation to the $C_b$ determined as effective.

Resource: in order not to increase the energy consumption and depending on the type of actuators (steady or periodic), power resources should be identified within the building environment either by using mechanically driven air flow or naturally driven flows caused by pressure differences, due to stack or wind pressure.

Controls: in order to address local conditions along the building façade, an FAM system may comprise sensors that detect oncoming flow conditions, and adaptive controllers that would process the sensors' information and provide control signals to the actuators, which in turn would determine the magnitude and modulation (in case of periodic forcing). The adaptability may not only provide localized interaction along the building's height or sides, but may also enable addressing changes in the built environment due to interference caused by new construction along the life span of the building in a densely populated urban environment.

Construction Costs

Although the application of FAM is yet to be evaluated in terms of the precise impact on construction costs, the potential impact on several parameters can be identified:

Structure: structural cost generally contributes approximately 20-25% to the overall construction cost and is driven mainly by the wind effect as mentioned above. Addressing wind loading by FAM may have an impact on the considerations that drive the choice of a structural system. By decoupling the aerodynamic performance from the building geometry, the build-ability and construction time may be significantly improved by, for example, a simpler building shape.

Façade: façade cost generally contributes approximately 15-18% to the overall construction cost. The more efficient the building shape and floor plate size, the lower the wall-to-floor ratio, which in turn may translate to a lower façade cost when expressed as a cost per unit of floor area. The ability to simplify the building shape and floor plan may also enable the adoption of a unitized curtain walling system which can be fabricated off-site and installed on-site from the floors, reducing demands on crane usage and hoisting time.

Floor plan: previous efforts have observed that improved aerodynamic performance may be achieved at the expense of increased construction costs due to floor area loss and need to add compensatory floors. The system described herein would not have this drawback because the air flow control is accomplished by fluid flow and not by the structure of the building itself.

Discussion

The results herein indicate that a fluid-based approach to tall building aerodynamic performance may be a useful framework for re-examining the interaction of airflows in and around the building systems matrix. The challenges associated with the inherent inconsistency of air flow may open a new way of thinking about tall buildings as highly adaptive, dynamic systems capable of responding to the opportunities and challenges associated with spatially and temporally fluctuating resources.

Figure 8:
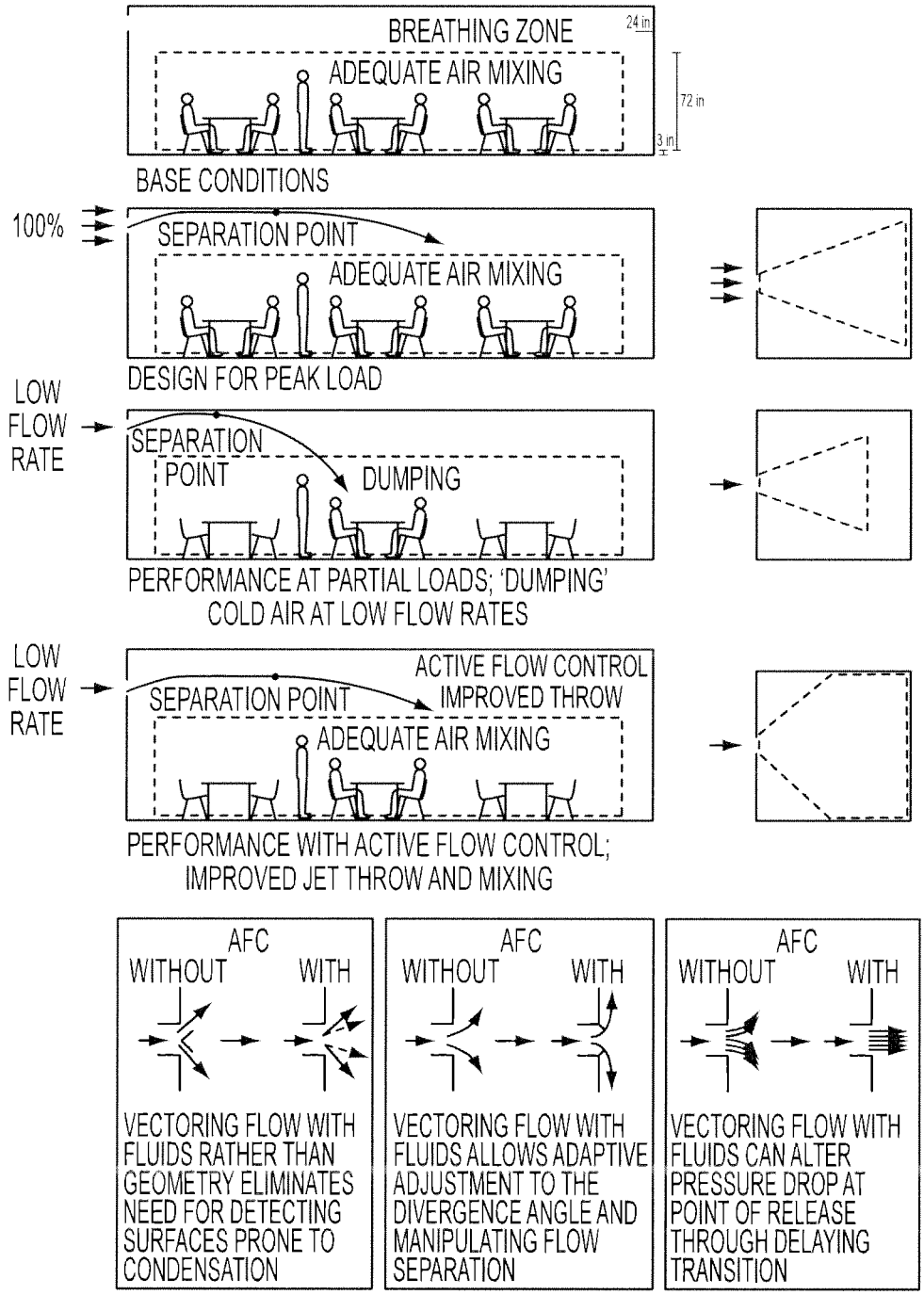
FIG. 8 provides a schematic diagram illustrating a possible scenario of how FAM impacts indoor environment in one embodiment.
Figure 9:
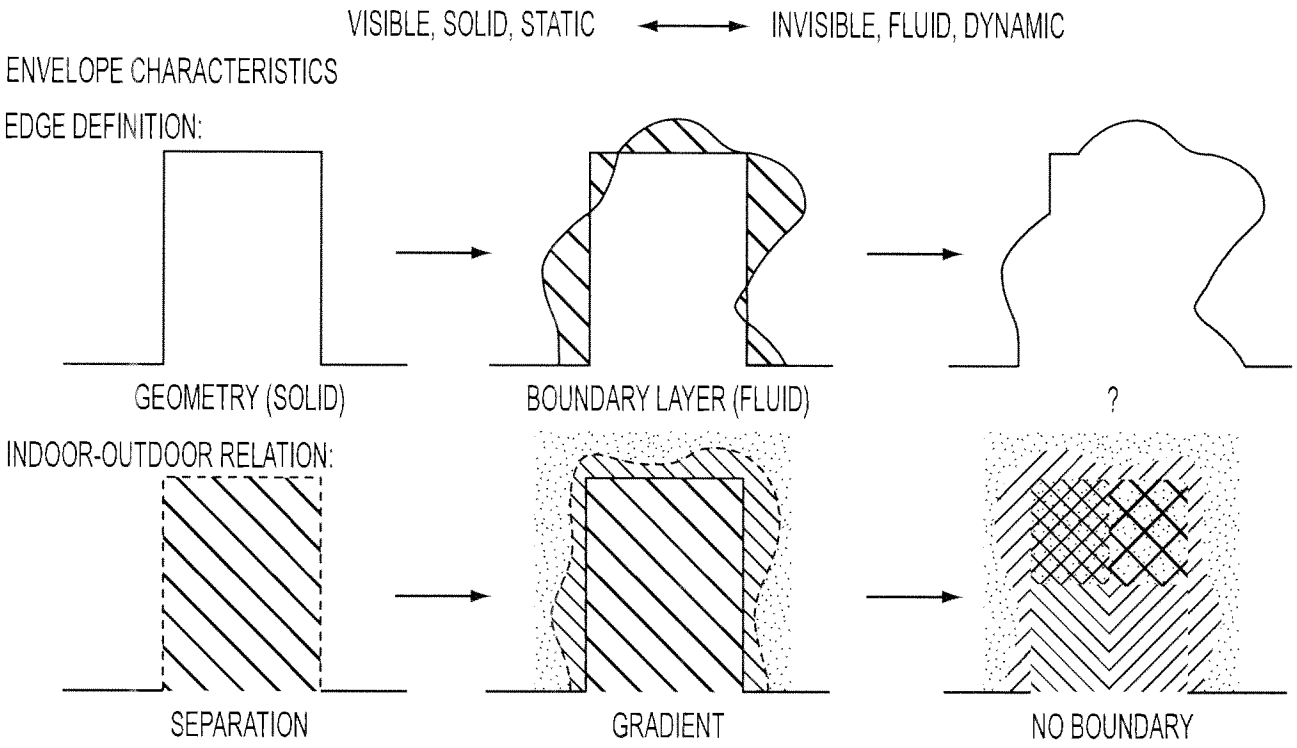
FIG. 9 provides a schematic showing how modified air flow may redefine the building envelope in one embodiment.
Figure 10:
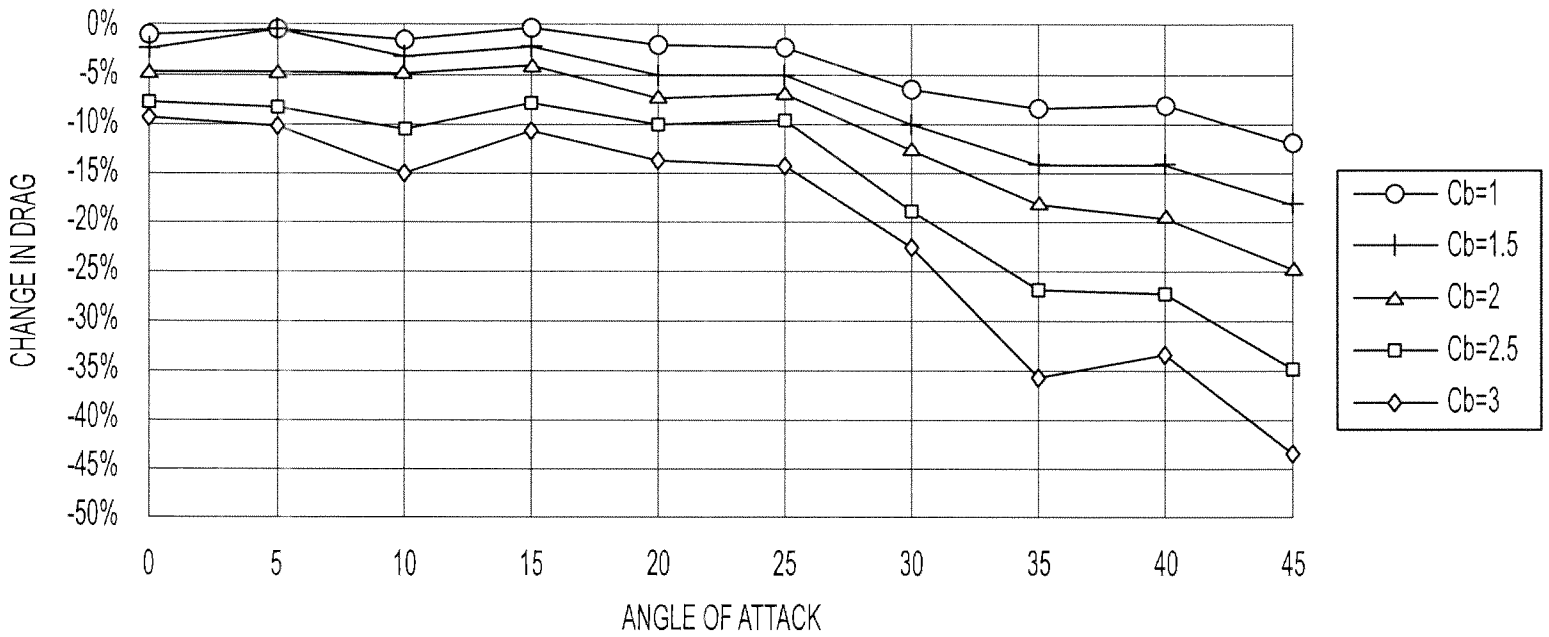
FIG. 10 illustrates an FAM model showing relative impact of forcing on drag reduction in comparison to a baseline without forcing in one embodiment; drag reduction is up to 45%.

Viewing tall building through a fluidic lens needs the development and integration of aerodynamic performance design methodologies and tools. This could also lead to finding untapped fluidic resources in the interior and exterior environment of the building for actuation. The development of scaling techniques to assess FAM impact may be important for these purposes. FIGS. 8-10 provide several schematics showing how the active fluid control system and/or methods may be applied to the various locations related to a building structure, and the effects thereof.

The significance of controlling the aerodynamic performance of a structure solely by the manipulation of its flow field with fluidic intervention also has the potential to impact global energy and resource consumption. Extending the definition of a body beyond the solid edge boundary of geometry to include the surrounding fluids may redefine other dynamic relationships between engineered structures and impact the potential for controlling heat and mass transfer across the façade, energy harvesting by building integrated wind turbines, natural ventilation strategies and indoor air management. See e.g., FIG. 9.

This transformative redefinition of the building systems matrix may challenge the binary division between the interior and exterior of the building—reflecting a long overdue challenge to the status quo which emanates from the prevailing paradigm where tall buildings are mechanically, internally driven and sealed from the built environment.

Example 3

BIAHFC System

Introduction

The following results were obtained by testing through tunnel experiments, simulations and building inspired prototypes with the goal of demonstrating the feasibility of the building integrated active and hybrid flow control ("BIAHFC") system. The three experimental Works conducted are described below.

The first Work investigated the interaction between air flow and building inspired models. The research included the design and fabrication of prototypes and validation through wind tunnel testing and simulations. This work focused upon the methodology, i.e., the study of AFC for building application by integrating actuators into finite models and affecting three dimensional flows around them. Particularly, this Work investigated two dimensional interactions which do not represent the complexity of flows around buildings. Although the primary motivation of this study was to achieve flow amplification for higher energy yield by building integrated wind turbines as demonstrated by the WARP design without the actual shaping of the building, its implications and applications lie beyond this motivation as will be described below.

Figure 14:
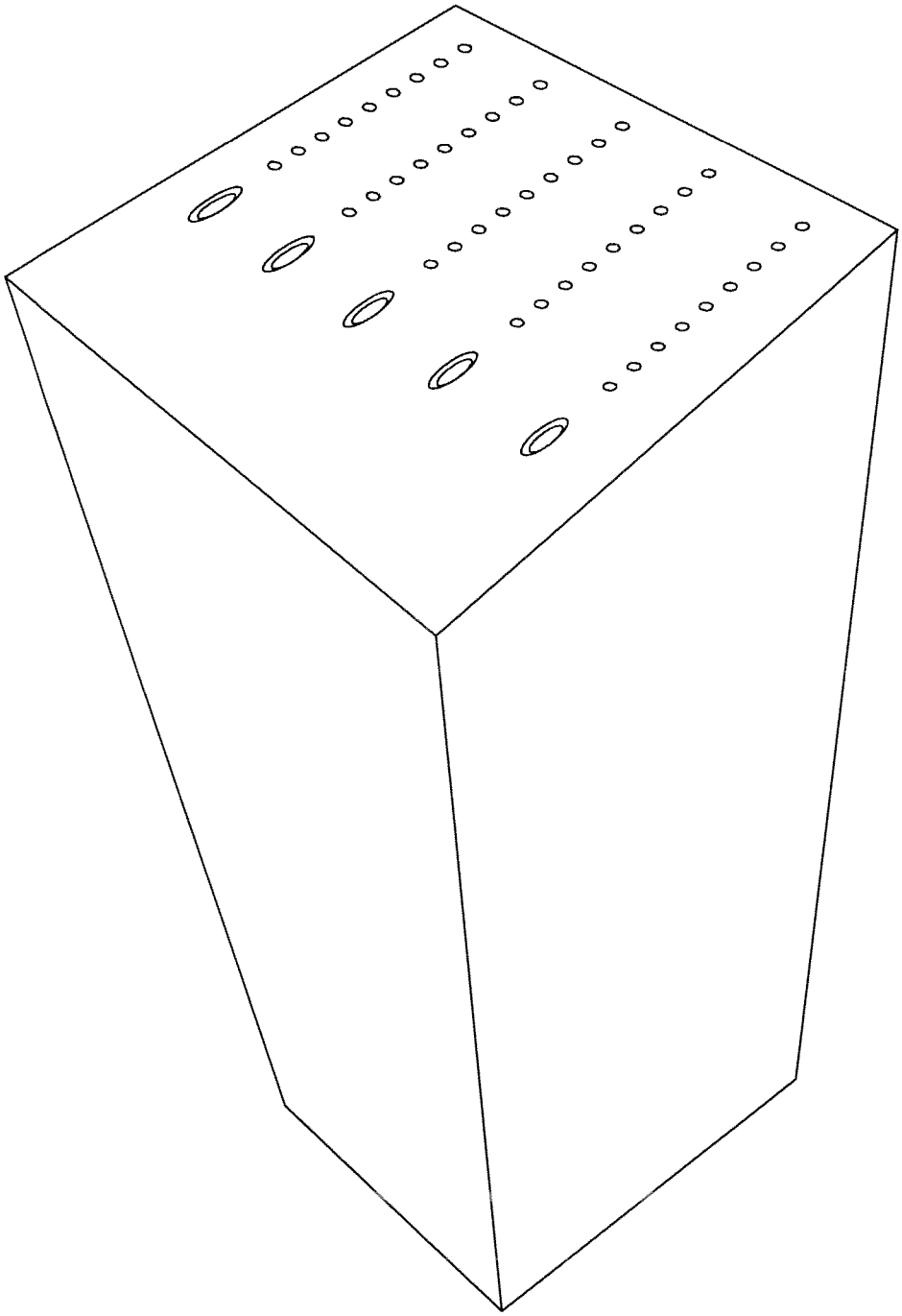
FIG. 14 shows a model that represents a reduced scale (1:200) 20 stories building in one embodiment; the elliptical shape at the top of the model is 5 jets fed by compressed air (steady forcing) and the array of holes are pressure ports that measure the surface pressure affected by the use of the jets.
Figure 15:
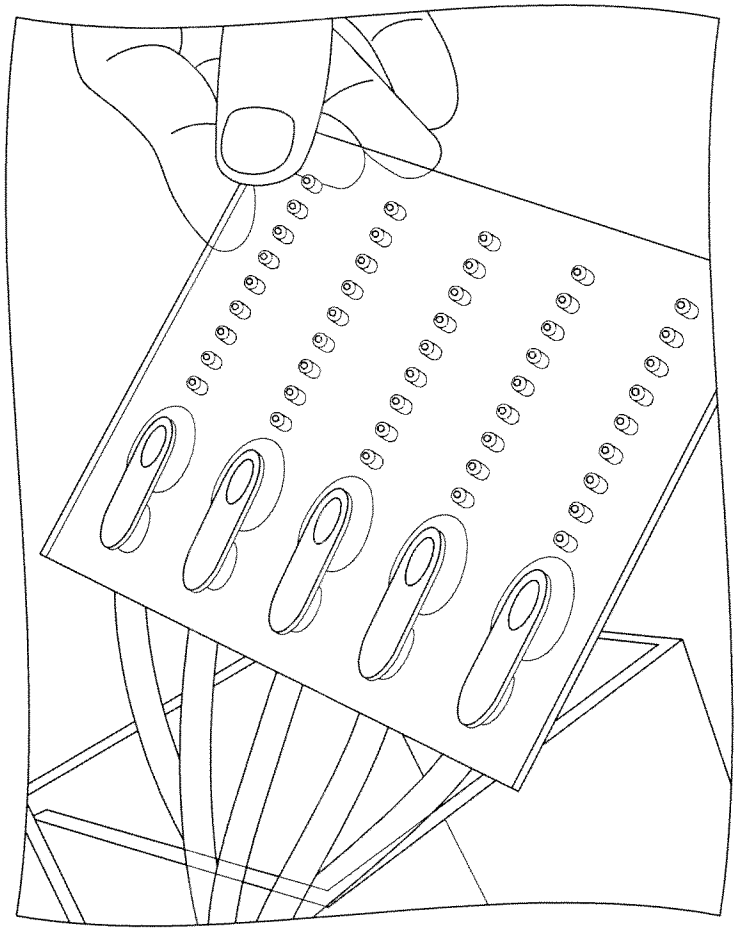
FIG. 15 illustrates the top of the model as shown in FIG. 14 (before painting) showing the flexible tubes that feed the jets with compressed air in one embodiment.
Figure 16:
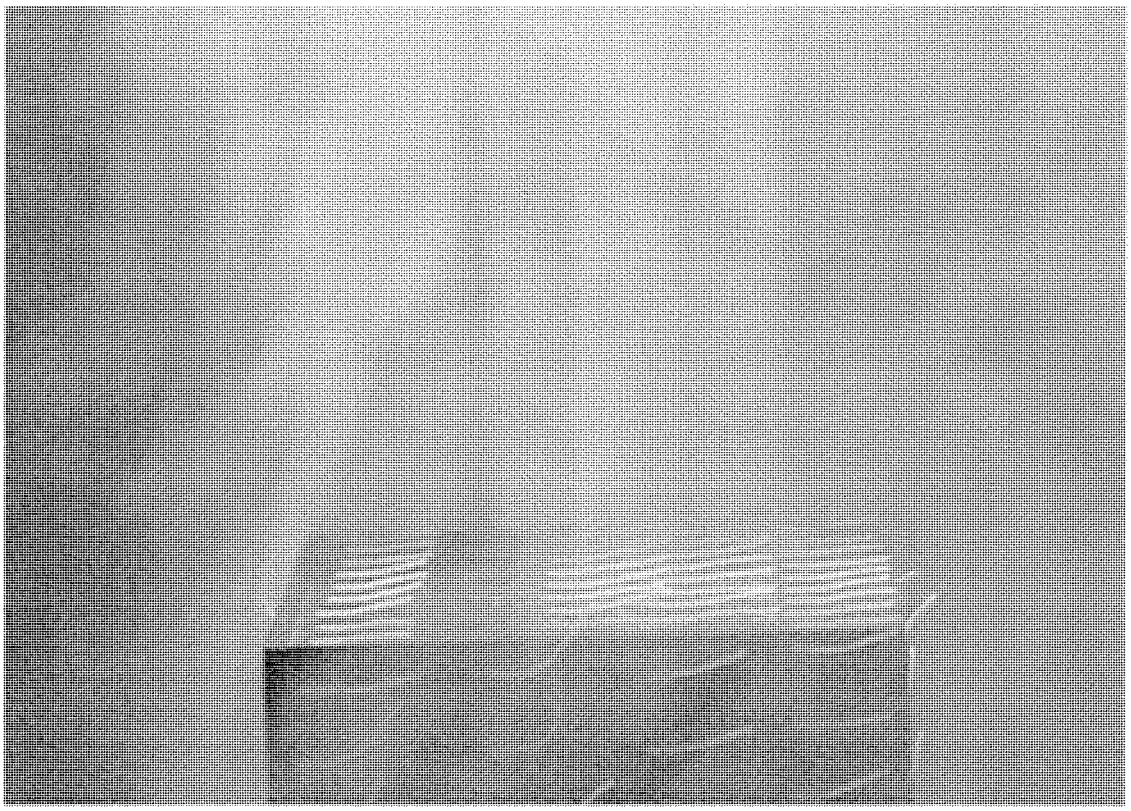
FIG. 16 illustrates the top of the model as shown in FIG. 14 when jets are not applied: the flow (visualized by smoke) separating at the windward edge of the top of the prism (flow left to right) in one embodiment.
Figure 17:
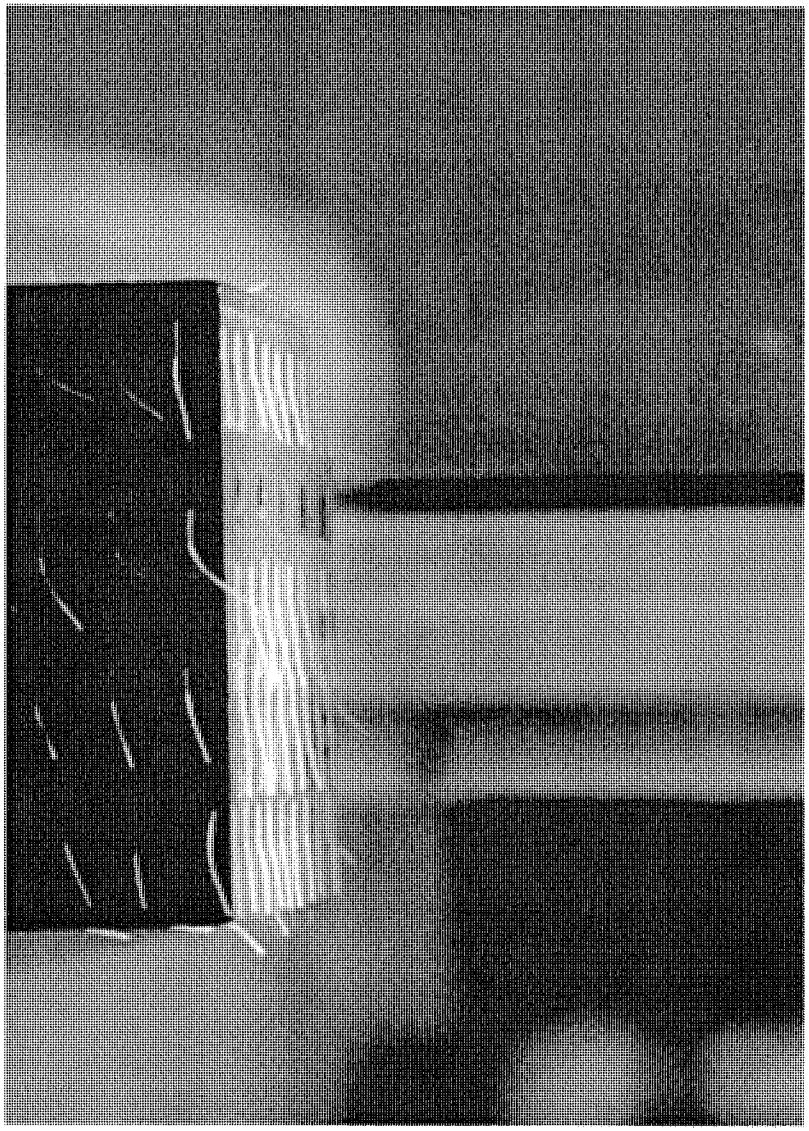
FIG. 17 illustrates the top of the model as shown in FIG. 14 when jets are applied: the flow (visualized by smoke) attaching to the top of the prism in one embodiment.

The second Work described is a wind tunnel experiment studying the effect of jets integrated at the parapet of a low rise building on the flow past it. Referring to FIG. 14, prototype used for this study represents a 20 story square office building in order to represent building stock relevant for BIAHFC systems. This Work demonstrated that applying jets to the building's parapet changed the flow past a sharp edged geometry. In this embodiment, the results show reduction of wind loads on many structures attached to the building (air handling units, antennas, structural support to integrated and mounted wind turbines, PV panels, etc.) and the potential improvement of energy yield by roof top mounted turbines.

The third Work focused on controlling indoor air and air borne contaminates in enclosed spaces. This Work was conducted using two types of actuating devices: synthetic jets (unsteady forcing) and compressed air jets (steady forcing). The studies demonstrated the ability to change the flow field around and at the top of circular and rectangular models in order to address prevalent building shape types. The models did not use any moving parts to alter the flow.

Experimental Works

Figure 12:
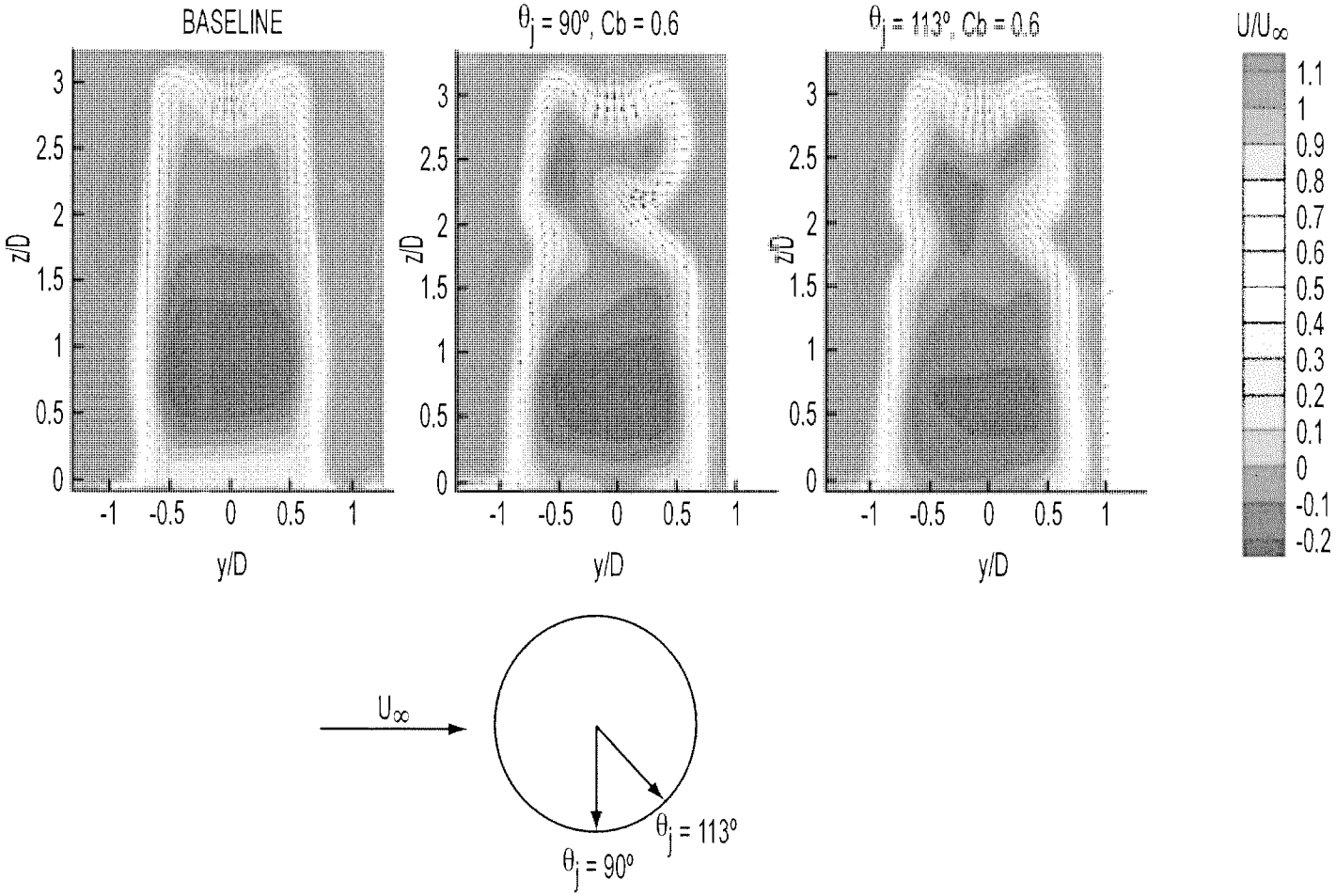
FIG. 12 illustrates stereoscopic partial image velocimetry ("PIV") data in one embodiment collected for the finite cylinder for the baseline and two forcing cases, at a stream wise location one-diameter downstream, or 10.16 cm (4 inches) from the axis of the cylinder; the colors represent out-of-plane velocities, while the vectors are in-plane velocity components.

Work 1:

The objective of the wind tunnel testing was to study the application of 3-D forcing on a 3-D bluff body in order to explore the application of active flow control to reduce and alter the flow around a low aspect ratio cylindrical model. The flow field around the model, the global aerodynamics loads and moments, and the model/flow interaction were changed. The research aimed to manipulate the aerodynamics loads and to control the flow properties such as its velocity at targeted locations around the model. Synthetic jets were applied in three different combinations (see FIG. 6(*a*)) along the span of the cylinder: 1 jet, 2 jets, and 3 jets. These combinations aimed to study the effect an individual jet, as well as an array of jets on the flow past a building. FIG. 12 shows the results of forcing on a finite cylinder using surface pressure measurements and Stereoscopic PIV measurements of the cylinder wake:

1. The downwash created a unique flow field that responds to jet forcing differently than a 2-D cylinder.
2. The interaction of the jet with the downwash resulted in a global change to the cylinder flow field that can be felt some distance downstream of the cylinder.
3. Alterations to the wake resulted in large reductions in pressure drag and an induced lateral force evidenced by wake vectoring.

As is evident from the baseline, the downwash creates a double peak at the free end, while also decreasing the velocity deficit. At both jet angles, higher momentum fluid is entrained towards the centerline of the wake, both narrowing the wake structure and vectoring it, leading to an induced lateral force (i.e. lift).

The results suggest the feasibility of BIAHFC systems, operating under the same conditions, to ameliorate the aerodynamic performance of the building by fluidic means only. By controlling the flow around the models, wind induced loads were decreased (FIG. 13) and air velocity was increased in desired location(s). Thus, BIAHFC, particularly with synthetic jet actuators, may be useful to improve the performance of buildings. Specifically, BIAHFC may provide the ability to use the system to reduce wind loads on buildings and to increase wind energy production from building integrated wind turbines.

Referring to FIG. 13, based on the azimuthal distribution, the jet is capable of enacting a global change to the surface pressure by altering the circulation. However, due to the presence of the downwash, it seems that the effect of the jet in this Work is localized around the immediate vicinity of the jet orifice. The span wise graph (on the right), shows non-dimensionalized pressure versus span wise distance. As a result, the single jet results in a large span wise change to the surface pressure. This is significant, particularly because the ratio of the jet orifice to the diameter of the cylinder is 1/100.

Work 2:

Studies were conducted on a low aspect ratio finite prism to investigate the effect of steady forcing on flow separation at the top. The results showed that the flow passing the top was manipulated by the use of compressed air jets and that the pressure on the surface of the roof was decreased when forcing was applied. Not to be bound by any theory, but roof top mounted equipment (e.g., air handling units, solar panels, antennas etc.) would be exposed to decreased wind loads and wind turbines will face better wind conditions and less structural loads, which will augment their energy yield and decrease their structural requirements.

Work 3:

Synthetic jet actuators successfully controlled dispersion and removal of airflow and aerosol in a closed chamber with a simulated ventilation system. Even for the largest particles used (~100 μm), the particles followed the carrier air closely yielding a substantial effect on the vectoring and removal of aerosol plume. The results demonstrated the applicability and suitability of BIAHFC for controlling indoor air quality in confined spaces.

Example 4

This Example provides a new approach to reduce these areas of environmental impact by augmenting SAM methods with 'fluid-based aerodynamic modification' ("FAM"), methods derived from flow control techniques first developed for the aerospace industry. FAM constitutes a different approach that allows for multi-variable optimization: instead of relying uniquely on the adjustment of the solid material within the structure to improve the aerodynamic 'shape' of the building, fluid-based active flow control is added to the building systems matrix in order to manipulate the building boundary layer to change the aerodynamic behavior and thus achieve a desired performance for both interior and exterior applications. Experimental results are presented herein to demonstrate application of FAM to tall building aerodynamic modification.

System Description:

The application of FAM to tall buildings involves three components:

Actuation: in order to achieve the desired effect on performance, fluidic actuators would be incorporated into the building floor plan and their orifices integrated into the building's façade. In order to achieve significant results with the least energy investment, their vicinity to known separation points, mostly at the building's hard edges, is preferred. The orifices' design is mainly determined by the angle needed in which the flow is injected in order to affect low momentum areas in the separated region, and its dimensions by the flow rate available in relation to the jet velocity determined as effective. The actuators can be:

- Pulsating jets (driven by power applied to a piezoelectric disc or other mechanism).
- Steady jets (using compressed air provided by a compressor).
- Air funnel apparatus—with a moving flap which operates by sucking air from high air pressure areas around the building and blowing the air at low air pressure areas.
- Hybrid apparatus—a hybrid of the air funnel and synthetic jets located around the exit plane, or orifice, facing the low pressure area where the synthetic jets would be used to augment and vector the air flow channeled through the funnel.

Energy resource: In order not to increase the energy consumption and depending on the type of actuators (steady or periodic), power resources should be identified within the building environment:

- Using mechanically driven air flow by such as HVAC exhaust air.
- Naturally driven air flows caused by thermal differences (buoyancy).
- Naturally driven air flows caused by wind pressure causing air moving from high to low air pressure by channels.

Controls: In order to address local conditions along the building façade, an FAM system may comprise sensors that detect oncoming flow conditions, and adaptive controllers that would process the sensors' information and provide control signals to the actuators, which in turn would determine the magnitude and modulation (in case of pulsating jets). The adaptability would not only provide for localized interaction along the building's height or sides, but would also enable addressing changes in the built environment due to interference caused by new construction along the life span of the building in an densely populated urban environment.

Example 5

The integration of active flow control devices into diffusers may allow vectoring the flow in indoor spaces with very little energy and with much higher precision. The ability to control the flow through fluidic (e.g., air) intervention instead of the use of deflectors, vanes, or other moving parts may save energy by reducing the need for mechanical or pneumatic devices, and reduce drag losses and moldiness that can develop on deflecting surfaces due to condensation. The result would be increased end-user energy efficiency while achieving better air quality and thermal comfort from superior air mixing. Conventionally, successful end-use occupant comfort is regulated primarily by adequate air mixing providing a limited thermal gradient in indoor occupied spaces. While the use of variable air volume ("VAV") air terminals modulates air flow in order to save energy in addition to providing thermal comfort, at reduced airflows, the diffuser selected for its performance characteristics at the peak design flow rate, may operate ineffectively. Below peak load design, VAV diffusers no longer provide adequate face velocity or throw, and no longer thoroughly mix the room air. The conditioned air delivered from the diffuser "dumps" directly down into the space, and areas located between diffusers receive no air movement, leading occupants to report "stuffy" conditions. Therefore, this system is unacceptable from the standpoint of occupant comfort.

In response to the failure of VAV units to achieve proper air mixing and thermal comfort, designers often specify the use of series fan powered box ("FPB") terminal units. Improved air diffusion is among the perceived benefits of implementing an FPB. Since an FPB has a constant airflow rate, the diffusers served by a FPB terminal unit can be selected to optimize the diffuser face velocity and throw, in order to maintain consistent mixing of room air, providing more uniform temperatures and improving occupant comfort. However, the constant volume operation of the FPB does not offer energy savings attributed to reducing airflow based on load changes.

This Example investigated the potential energy and cost savings benefits possible by improving air diffuser design. The goal was to develop a diffuser design that improves air distribution effectiveness for a wide range of varying airflows. One objective was to improve occupant comfort at all load conditions and allow the designer to utilize a cost effective VAV terminal unit where they may have previously used a less efficient FPB terminal unit.

System Description

The system is similar to a system for exterior control as described above. Jets may be integrated into a ceiling, floor or wall mounted diffuser. The diffuser may be located centrally or next to one of the sides of the room and may have various shapes such as rectangular, circular, linear, etc. The jets may be integrated into the exit plane of the diffuser with the goal of manipulating air flow travelling through the HVAC duct and into the diffuser to be distributed where and in the capacity needed. Air may be manipulated based on input from controllers which may be receive real time air measurements data from sensors located in the room.

Applications

Controlling Indoor Flow Distribution:

Sensors are located in the building interior and measure air velocity, room temperature and occupancy. Once change is needed to the air flow coming from the HVAC system; jets, which are integrated into the HVAC diffusers, may be released to either modify the throw, the spread or the velocity of the main air flow provided by the HVAC through the diffuser and into the room.

Controlling Aerosol Dispersion And Removal In Confined Spaces

Sensors may be located in the building interior and measure air content (gazes). Once a plume of gas has been detected and is removed, jets, which are integrated into the HVAC diffusers, may be released to either modify the throw, the spread or the velocity of the main air flow provided by the HVAC through the diffuser in order to vector the plume to a separate vent and removed from the habitable space.

Referring to FIG. 34, several components of an integrated system are described. Device 1 is a roof top diffuser/actuator: an apparatus installed on the top of the building. This device connects to the building parapet either as an autonomous unit or as part of the building curtain wall. The device contains jets (cavity and orifice) and tubes that connect the jets to HVAC release air ducts. Release flow from the HVAC system is guided through this connection and released through the jets. The jets are shaped with a narrowing section in order increase the air velocity to affect the air flow at the top of the building. Synthetic jets may be incorporated at the exit plane of the jet (orifice) in order to vector precisely and in an energy efficient manner the flow coming through the jet cavity.

Figure 25:
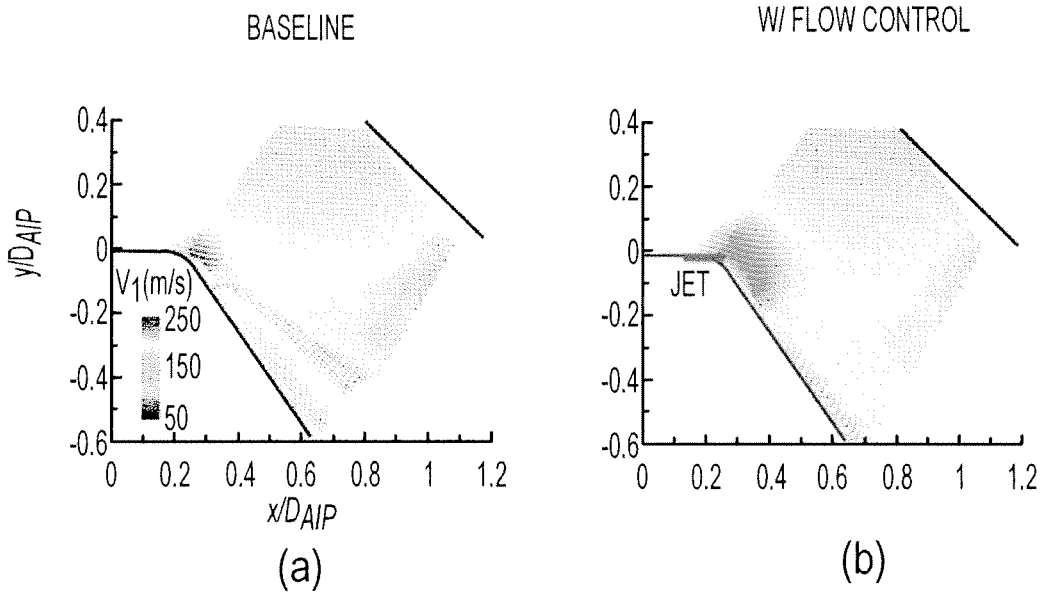
FIGS. 25(*a*)-25(*b*), respectively, show a schematic of velocity vector fields of inlet ducts with and without active fluid control for separation mitigation in one embodiment.

Device 2 is a spandrel diffuser/actuator: an apparatus installed on the façade of the building. This device is a part of the building curtain wall. The device contains a jet (inlet, duct and orifice). FIG. 25 shows a schematic of velocity vector fields of inlet ducts with and without active fluid control for separation mitigation in one alternative embodiment. FIG. 26 provides a schematic showing an impact of the system described in one alternative embodiment on heat transfer at the building envelope. The jet is shaped with a narrowing section in order increase the air velocity and is located close to building corners in order to take advantage of air pressure on both sides of the corner which will cause air to be sucked through the jet on the inlet side and released at higher velocity on the orifice side. Synthetic jets may be incorporated at the exit plane of the jet (orifice) in order to vector precisely and in an energy efficient manner the flow coming through the jet cavity.

Device 3 is a spandrel diffuser/actuator: an apparatus installed on the façade of the building. This device is a part of the building curtain wall. The device contains a jet (inlet, duct and orifice). The jet is shaped with a narrowing section in order increase the air velocity and is located close to building corners in order to take advantage of air pressure on both sides of the corner which will cause air to be sucked through the jet on the inlet side and released at higher velocity on the orifice side. Synthetic jets may be incorporated at the exit plane of the jet (orifice) in order to vector precisely and in an energy efficient manner the flow coming through the jet cavity.

Device 5 is an indoor diffuser/actuator: an apparatus installed on the interior walls/suspended ceiling/raised floor of indoor spaces. This device is a part of the building HVAC system. The device contains a main HVAC air flow passage channel and an array of synthetic jets incorporated at the exit plane of the HVAC in order to vector precisely and in an energy efficient manner the flow coming through the HVAC duct.

Device 6 is an active flow control panel: an apparatus installed on the façade of the building. This device is a part of the building curtain wall. The device contains an array of synthetic jets incorporated into the panel surface and a sensor. The device is connected to a controller. Based on the controller data, jets are activated and the sensor measures flow characteristics to close the loop.

Example 6

Experimental Goals

This Example demonstrates the ability of FAM to optimize aerodynamic performance without physically changing or modifying the structure (which results in consequent loss of space or increased use of materials and energy.) Decoupling aerodynamic performance from structural or geometric characteristics for complex fluid/structure interactions would allow buildings to respond better to mean and fluctuating wind loads while increasing their economic feasibility, and therefore their viability, to become a prevalent sustainable building typology suitable for the projected rapid urban population growth. This example demonstrates the feasibility of the FAM approach for manipulating air flow conditions and specifically reducing wind loads applying on buildings.

Experimental Set Up

The experiments were conducted in an open-return low speed wind tunnel at RPI. The wind tunnel has a 0.8×0.8×5 m aerodynamic test section with a maximum speed of 50 m/s and a turbulence level of less than 0.25%. Atmospheric boundary layer was simulated through an extension to the wind tunnel with a test section 1.2×1.2× boundary layer turbulence simulated by floor mounted panels with roughness blocks. Forces and overturning moments were measured using a high frequency force balance ("HFFB") with resonant frequencies of 1400 Hz ($F_x$, $F_y$, $T_z$) and 2000 Hz ($F_z$, $T_x$, $T_y$). All tests were conducted at $U_\infty$=10 m/s and angles of attack between 0 and 45 degrees.

The Tested Model

FAM Model: a steady forcing model (model A) with a rectangular section and aspect ratio of 1:2:15 (34 mm: 68 mm: 520 mm) incorporated an array of 11 jets (5 jets on each side and one at the top), located at x/D=~0.08 (as close as possible to the leading edge). The jet release angle was designed to be parallel to the narrow side of the model to impact the area of decelerated flow in the separated region. Steady jets were fed by compressed air lines at a different chosen flow rates. Blowing ratios were calibrated by a hot wire to pressure sensor input.

Results

The results showed a substantial impact of forcing on aerodynamic loads. A clear correlation was found between the increase in jets velocity and reduction in drag (see FIG. 2).

Conclusion

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments of the invention can be implemented in any of numerous ways. For example, some embodiments may be implemented using hardware, software or a combination thereof. When any aspect of an embodiment is implemented at least in part in software, the software code can be executed on any suitable processor or collection of processors, whether provided in a single computer or distributed among multiple computers.

In this respect, various aspects of the invention may be embodied at least in part as a computer readable storage medium (or multiple computer readable storage media) (e.g., a computer memory, one or more floppy discs, compact discs, optical discs, magnetic tapes, flash memories, circuit configurations in Field Programmable Gate Arrays or other semiconductor devices, or other tangible computer storage medium or non-transitory medium) encoded with one or more programs that, when executed on one or more computers or other processors, perform methods that implement the various embodiments of the technology discussed above. The computer readable medium or media can be transportable, such that the program or programs stored thereon can be loaded onto one or more different computers or other processors to implement various aspects of the present technology as discussed above.

The terms "program" or "software" are used herein in a generic sense to refer to any type of computer code or set of computer-executable instructions that can be employed to program a computer or other processor to implement various aspects of the present technology as discussed above. Additionally, it should be appreciated that according to one aspect of this embodiment, one or more computer programs that when executed perform methods of the present technology need not reside on a single computer or processor, but may be distributed in a modular fashion amongst a number of different computers or processors to implement various aspects of the present technology.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, the technology described herein may be embodied as a method, of which at least one example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." Any ranges cited herein are inclusive.

The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

What is claimed:

1. A method of modifying an air flow at one or more locations of a building structure, comprising: generating a first air flow by a synthetic jet actuator device positioned at the one or more locations of the building structure, first air flow being an unsteady flow; and actively controlling a second air flow exterior to the building structure using the generated first air flow, wherein the actively controlling comprises periodic excitations by an oscillatory addition of a momentum from the first air flow to the second air flow.

2. The method of claim 1, wherein the actively controlling further comprises applying the generated first air flow at an angle to the second air flow to generate a third air flow different from the second air flow.

3. The method of claim 1, wherein the one or more locations comprises at least one of a side and a top of the building structure.

4. The method of claim 1, wherein the one or more locations is integrated in a building envelope of the building structure.

5. The method of claim 1, further comprising using a pressure differential to transfer into an interior of the building structure the second air flow and releasing the transferred-in second air flow back to an exterior of the building structure.

6. The method of claim 1, further comprising managing the actively controlling by a closed loop control system.

7. The method of claim 1, further comprising managing the actively controlling by a closed loop control system comprising at least one of building integrated sensors, controllers, and actuators.

8. The method of claim 1, further comprising using an energy source to generate the first air flow, the energy source configured to operate independently of an existing power system of the building structure.

9. The method of claim 1, further comprising using an energy source to generate the first air flow, the energy source being an integral part of an existing power system of the building structure.

10. The method of claim 1, further comprising using the actively controlled second air flow to generate electrical power at the building structure.

11. The method of claim 1, further comprising using the actively controlled second air flow to control air filtration at a building envelope of the building structure.

12. The method of claim 1, further comprising using the actively controlled second air flow to reduce at least one of (i) wind load and (ii) cross wind response on the building structure.

13. The method of claim 1, wherein the actively controlling involves substantially no change of a geometry of the building structure.

14. The method of claim 1, wherein the device is a periodic excitation actuator.

15. The method of claim 14, wherein the actuator comprises a piezoelectric disc.

16. The method of claim 1, wherein said actively controlling comprises imposing on the second flow to have a specific flow velocity, a specific flow direction and/or a specific flow manner selected from a turbulent flow manner and a laminar flow manner.

17. An apparatus configured to actively control an air flow at one or more locations of a building structure, the apparatus comprising: an apparatus housing; and a synthetic jet actuator in the housing, the synthetic jet actuator configured to generate a first air flow at the one or more locations, wherein the first air flow is an unsteady flow, and wherein the generated first air flow controls a second air flow by an oscillatory addition of a momentum from the first air flow to the second air flow exterior to the building structure.

18. The apparatus of claim 17, wherein the apparatus is located at an edge of the building structure.

19. The apparatus of claim 17, wherein the at one or more locations comprises at least one of a side of the building, a top of the building, and a location integrated into a building envelope of the building structure.

20. The apparatus of claim 17, wherein the apparatus is located at a location, which is different from the one or more locations.

21. The apparatus of claim 17, wherein the apparatus housing is at least one of (i) mounted on and (ii) integrated into an edge of the building structure.

22. The apparatus of claim 17, wherein the generated first air flow exits the apparatus housing at an angle to the second air flow.

23. The apparatus of claim 17, further comprising an energy source configured to provide energy to generate the first air flow.

24. The apparatus of claim 17, further comprising an energy source configured to provide energy to generate the first air flow, wherein the energy source is configured to divert energy from an existing power system of the building structure.

25. The apparatus of claim 17, further comprising an energy source configured to provide energy to generate the first air flow, wherein the energy source is configured to operate independently of an existing power system of the building structure.

26. The apparatus of claim 17, wherein the flow generator is a periodic excitation actuator.

27. The apparatus of claim 26, wherein the actuator comprises a piezoelectric disc.

28. The apparatus of claim 17, wherein the generated first air flow actively controls the second air flow by imposing on the second flow to have a specific flow velocity, a specific flow direction and/or a specific flow manner selected from a turbulent flow manner and a laminar flow manner.

29. A building structure, comprising the apparatus of claim 17.

30. A building structure, comprising an apparatus at one or more locations of the building structure, the apparatus comprising: an apparatus housing; and a synthetic jet actuator in the housing, the synthetic jet actuator configured to generate a first air flow at the one or more locations, wherein the first air flow is an unsteady flow, and wherein the generated first air flow actively controls a second air flow by an oscillatory addition of a momentum from the first air flow to the second air flow exterior to the building structure at the one or more locations of the building structure.

31. The building structure of claim 30, wherein the building structure further comprises a power generating device configured to generate electrical power using at least the actively controlled second air flow.

32. The building structure of claim 30, wherein the building structure further comprises an air filtration system configured to filter air in an interior of the building structure using at least the actively controlled second air flow.

33. The building structure of claim 30, wherein the building structure further comprises a heat transfer system configured to exchange heat between an interior and an exterior of the building structure using at least the actively controlled second air flow.

34. The building structure of claim 30, wherein the flow generator is a periodic excitation actuator.

35. The building structure of claim 34, wherein the actuator comprises a piezoelectric disc.

36. The building structure of claim 30, wherein the generated first air flow actively controls the second air flow by imposing on the second flow to have a specific flow velocity, a specific flow direction and/or a specific flow manner selected from a turbulent flow manner and a laminar flow manner.

* * * * *